US009957080B2

(12) United States Patent
Kastanek

(10) Patent No.: US 9,957,080 B2
(45) **Date of Patent: *May 1, 2018**

(54) REINFORCED PACKAGE

(71) Applicant: Graphic Packaging International, Inc., Atlanta, GA (US)

(72) Inventor: Raymond S. Kastanek, Mead, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/630,061

(22) Filed: Jun. 22, 2017

(65) Prior Publication Data

US 2017/0283111 A1 Oct. 5, 2017

Related U.S. Application Data

(63) Continuation-in-part of application No. 15/217,026, filed on Jul. 22, 2016, now Pat. No. 9,771,176, which (Continued)

(51) Int. Cl.
*B65D 5/60* (2006.01)
*B31B 1/62* (2006.01)

(Continued)

(52) U.S. Cl.
CPC ..... *B65D 5/443* (2013.01); *B31B 7/00* (2013.01); *B65D 5/029* (2013.01); *B65D 5/0227* (2013.01);

(Continued)

(58) Field of Classification Search
CPC ..... B65D 5/606; B65D 5/72; B31B 11/00; B31B 1/62; B31B 1/78

(Continued)

(56) References Cited

U.S. PATENT DOCUMENTS 1,474,088 A 11/1923 Reynolds
1,516,090 A 11/1924 Gary et al.

(Continued)

FOREIGN PATENT DOCUMENTS

CA 2 384 311 3/2001
CA 2 586 472 5/2006

(Continued)

OTHER PUBLICATIONS

International Search Report and Written Opinion for PCT/US2017/038694 dated Sep. 25, 2017.

(Continued)

*Primary Examiner* — Christopher Demeree
(74) *Attorney, Agent, or Firm* — Womble Bond Dickinson (US) LLP

(57) ABSTRACT

A reinforced package comprising a carton comprising a plurality of panels that can comprise a first side panel connected to a front panel along a first fold line, a back panel connected to the first side panel along a second fold line, and a second side panel connected to the front and/or back panels. The reinforced package further can comprise a bag that can have an at least partially open end, an at least partially closed end, and an interior space. The carton can be positionable in non-erect and erect positions, and the carton can be configured to support the bag in the erect position. The first and second side panels can comprise retention features for at least partially retaining the carton in the erect position, and the retention features can comprise at least a V-shaped fold line extending in the first side panel from the first fold line.

52 Claims, 14 Drawing Sheets

Related U.S. Application Data is a continuation-in-part of application No. 14/496,252, filed on Sep. 25, 2014, now Pat. No. 9,758,275.

(60) Provisional application No. 62/354,270, filed on Jun. 24, 2016, provisional application No. 62/282,049, filed on Jul. 23, 2015, provisional application No. 61/960,712, filed on Sep. 25, 2013.

(51) Int. Cl.

| | |
|---|---|
| ***B65D 5/72*** | (2006.01) |
| ***B65D 5/44*** | (2006.01) |
| ***B65D 5/02*** | (2006.01) |
| ***B65D 5/42*** | (2006.01) |
| ***B31B 7/00*** | (2006.01) |
| ***B65D 5/36*** | (2006.01) |

(52) U.S. Cl.
CPC ..... *B65D 5/3628* (2013.01); *B65D 5/4266* (2013.01); *B65D 5/606* (2013.01); *B31B 2217/0038* (2013.01)

(58) Field of Classification Search
USPC ..... 229/117.34, 117.32, 117.05, 117.3, 229/117.27, 902, 904; 493/99, 100, 128; 383/33, 104
See application file for complete search history.

(56) References Cited

U.S. PATENT DOCUMENTS

| | | | |
|---|---|---|---|
| 1,664,111 | A | 3/1928 | Johnson |
| 2,092,858 | A | 9/1937 | Richard |
| 2,099,257 | A | 11/1937 | Bergstein |
| 2,107,946 | A | 2/1938 | Inman |
| 2,132,966 | A | 11/1938 | O'Brien |
| 2,166,388 | A | 7/1939 | Bergstein |
| 2,197,133 | A | 4/1940 | Piazze |
| 2,250,249 | A | 7/1941 | Bergstein |
| 2,282,207 | A | 5/1942 | Palmer |
| 2,286,465 | A | 6/1942 | Clement |
| RE23,096 | E | 4/1949 | Mullinix |
| 2,553,923 | A | 5/1951 | Lambert |
| 2,835,435 | A | 5/1958 | Mullinix |
| 2,870,023 | A | 1/1959 | Vogt |
| 2,913,161 | A | 11/1959 | Travis |
| 2,987,402 | A | 6/1961 | Dold |
| 3,142,231 | A | 7/1964 | Christensson |
| 3,142,430 | A | 7/1964 | Meyers |
| 3,194,471 | A | 7/1965 | Murphy |
| 3,240,419 | A | 3/1966 | Spiering et al. |
| 3,249,286 | A | 5/1966 | Palmer |
| 3,250,454 | A | 5/1966 | Steiger |
| 3,272,423 | A | 9/1966 | Bjarno |
| 3,324,998 | A | 6/1967 | Farquhar |
| 3,357,631 | A | 12/1967 | Aid et al. |
| 3,399,818 | A | 9/1968 | Stegner |
| 3,428,235 | A | 2/1969 | Randazzo |
| 3,459,357 | A | 8/1969 | Egger et al. |
| 3,482,758 | A | 12/1969 | Pierre |
| 3,515,333 | A | 6/1970 | Kotkas et al. |
| 3,576,290 | A | 4/1971 | Marchisen |
| 3,627,541 | A | 12/1971 | Farquhar |
| 3,637,130 | A | 1/1972 | Farquhar |
| 3,659,777 | A | 5/1972 | Kanada et al. |
| 3,945,870 | A | 3/1976 | Johnsen |
| 3,964,669 | A | 6/1976 | Sontag et al. |
| 4,011,983 | A | 3/1977 | Greene |
| 4,082,216 | A | 4/1978 | Clarke |
| 4,196,035 | A | 4/1980 | Reil |
| 4,228,945 | A | 10/1980 | Wysocki |
| 4,267,955 | A | 5/1981 | Struble |
| 4,284,205 | A | 8/1981 | Hirata |
| 4,312,451 | A | 1/1982 | Forbes, Jr. |
| 4,313,542 | A | 2/1982 | Roberts et al. |
| 4,398,636 | A | 8/1983 | Baxter |
| 4,457,483 | A | 7/1984 | Gagne |
| 4,477,014 | A | 10/1984 | Brandenburger |
| 4,478,351 | A | 10/1984 | Homma |
| 4,484,683 | A | 11/1984 | Werner, Jr. |
| 4,494,785 | A | 1/1985 | Song |
| 4,575,000 | A | 3/1986 | Gordon et al. |
| 4,754,914 | A | 7/1988 | Wischusen, III |
| 4,775,771 | A | 10/1988 | Pawlowski |
| 4,785,696 | A | 11/1988 | Martiny |
| 4,865,921 | A | 9/1989 | Hollenberg |
| 4,890,439 | A | 1/1990 | Smart |
| 4,919,785 | A | 4/1990 | Willey et al. |
| 4,930,639 | A | 6/1990 | Rigby |
| 4,936,935 | A | 6/1990 | Beckett |
| 4,940,200 | A | 7/1990 | Sawyer |
| 4,963,424 | A | 10/1990 | Beckett |
| 5,028,147 | A | 7/1991 | Graham |
| 5,034,234 | A | 7/1991 | Andreas et al. |
| 5,071,062 | A | 12/1991 | Bradley et al. |
| 5,078,273 | A | 1/1992 | Kuchenbecker |
| 5,080,643 | A | 1/1992 | Mitchell et al. |
| 5,093,364 | A | 3/1992 | Richards |
| 5,096,723 | A | 3/1992 | Turpin |
| 5,117,078 | A | 5/1992 | Beckett |
| 5,132,124 | A | 7/1992 | Tamaki et al. |
| 5,175,404 | A | 12/1992 | Andreas et al. |
| 5,213,902 | A | 5/1993 | Beckett |
| 5,221,419 | A | 6/1993 | Beckett |
| 5,260,537 | A | 11/1993 | Beckett |
| 5,266,386 | A | 11/1993 | Beckett |
| 5,326,022 | A | 7/1994 | Green |
| 5,330,099 | A | 7/1994 | Beales et al. |
| RE34,683 | E | 8/1994 | Maynard |
| 5,337,951 | A | 8/1994 | Roccaforte |
| 5,340,436 | A | 8/1994 | Beckett |
| 5,346,311 | A | 9/1994 | Slier et al. |
| 5,354,973 | A | 10/1994 | Beckett |
| 5,410,135 | A | 4/1995 | Pollart |
| 5,411,165 | A | 5/1995 | Ellis |
| 5,424,517 | A | 6/1995 | Habeger |
| 5,427,267 | A | 6/1995 | Willman |
| 5,484,100 | A | 1/1996 | Rigby |
| 5,492,269 | A | 2/1996 | Sung |
| 5,510,132 | A | 4/1996 | Gallo, Jr. |
| 5,519,195 | A | 5/1996 | Keefer |
| 5,585,027 | A | 12/1996 | Young |
| 5,615,795 | A | 4/1997 | Tipps |
| 5,628,921 | A | 5/1997 | Beckett |
| 5,672,407 | A | 9/1997 | Beckett |
| 5,688,427 | A | 11/1997 | Gallo, Jr. |
| 5,759,422 | A | 6/1998 | Schmelzer |
| 5,800,724 | A | 9/1998 | Habeger |
| 5,921,681 | A | 7/1999 | Money |
| 5,938,110 | A | 8/1999 | Bernstein |
| 5,944,183 | A | 8/1999 | Rowland et al. |
| 5,964,161 | A | 10/1999 | Conway |
| 6,063,415 | A | 5/2000 | Walters |
| 6,082,613 | A | 7/2000 | Mikulski et al. |
| 6,114,679 | A | 9/2000 | Lai |
| 6,132,351 | A | 10/2000 | Lotto et al. |
| 6,139,662 | A | 10/2000 | Forman |
| 6,150,646 | A | 11/2000 | Lai et al. |
| 6,204,492 | B1 | 3/2001 | Zeng et al. |
| 6,234,384 | B1 | 5/2001 | Capy et al. |
| 6,251,451 | B1 | 6/2001 | Zeng |
| 6,253,993 | B1 | 7/2001 | Lloyd et al. |
| 6,254,519 | B1 | 7/2001 | Toshima |
| 6,335,042 | B1 | 1/2002 | Money |
| 6,349,874 | B1 | 2/2002 | Hill |
| 6,360,941 | B1 | 3/2002 | Larsson |
| 6,401,927 | B1 | 6/2002 | Sorensen et al. |
| 6,414,290 | B1 | 7/2002 | Cole |
| 6,431,365 | B1 | 8/2002 | Money |
| 6,433,322 | B2 | 8/2002 | Zeng et al. |
| 6,455,827 | B2 | 9/2002 | Zeng |
| 6,494,619 | B1 | 12/2002 | Sulpizio |
| 6,552,315 | B2 | 4/2003 | Zeng et al. |

(56) References Cited

U.S. PATENT DOCUMENTS

| | | | |
|---|---|---|---|
| 6,637,646 | B1 | 10/2003 | Muise et al. |
| 6,677,563 | B2 | 1/2004 | Lai |
| 6,683,289 | B2 | 1/2004 | Whitmore et al. |
| 6,695,202 | B2 | 2/2004 | Miess |
| 6,702,178 | B2 | 3/2004 | Bowers et al. |
| 6,717,121 | B2 | 4/2004 | Zeng |
| 6,744,028 | B2 | 6/2004 | Chisholm et al. |
| 6,765,182 | B2 | 7/2004 | Cole |
| 6,869,387 | B2 | 3/2005 | Post et al. |
| 6,986,920 | B2 | 1/2006 | Forman et al. |
| 7,019,271 | B2 | 3/2006 | Wnek et al. |
| 7,143,930 | B2 | 12/2006 | Money et al. |
| 7,414,230 | B2 | 8/2008 | Fitzwater |
| 7,473,875 | B2 | 1/2009 | Fitzwater |
| 7,510,515 | B2 | 3/2009 | Ichikawa |
| 7,604,155 | B2 | 10/2009 | Bossel et al. |
| 7,667,167 | B2 | 2/2010 | Fitzwater |
| 7,699,214 | B2 | 4/2010 | Mestre et al. |
| 7,819,583 | B2 | 10/2010 | Walker et al. |
| 7,837,606 | B2 | 11/2010 | Tetenborg et al. |
| 7,893,389 | B2 | 2/2011 | Fitzwater |
| 7,913,897 | B2 | 3/2011 | Manaige |
| 7,938,312 | B2 | 5/2011 | Ford |
| 7,959,060 | B2 | 6/2011 | Wilson et al. |
| 7,982,167 | B2 | 7/2011 | Fitzwater |
| 7,984,844 | B2 | 7/2011 | Jones |
| 8,013,280 | B2 | 9/2011 | Robison et al. |
| 8,066,137 | B2 | 11/2011 | Sanfilippo et al. |
| 8,142,077 | B2 | 3/2012 | Iannelli, II et al. |
| 8,196,805 | B2 | 6/2012 | Brand et al. |
| 8,206,033 | B2 | 6/2012 | Sato et al. |
| 8,226,794 | B2 | 7/2012 | Fogle |
| 8,309,896 | B2 | 11/2012 | Fitzwater |
| 8,317,671 | B1 | 11/2012 | Zoeckler |
| 8,403,819 | B2 | 3/2013 | Zoeckler |
| 8,403,820 | B2 | 3/2013 | Zoeckler |
| 8,468,782 | B2 | 6/2013 | Michalsky et al. |
| 8,474,163 | B2 | 7/2013 | Rubin |
| 8,500,330 | B2 | 8/2013 | Nomura et al. |
| 8,672,214 | B2 | 3/2014 | Manaige |
| 8,727,204 | B2 | 5/2014 | Burke |
| 9,108,761 | B2 | 8/2015 | Fitzwater et al. |
| 9,113,648 | B2 | 8/2015 | Burke |
| 9,156,579 | B2 | 10/2015 | Pinkstone |
| 9,156,582 | B2 | 10/2015 | Walsh et al. |
| 9,346,234 | B2 | 5/2016 | Hajek et al. |
| 9,346,582 | B2 | 5/2016 | Pinkstone |
| 9,463,896 | B2 | 10/2016 | Fitzwater |
| 2003/0002755 | A1 | 1/2003 | Kim et al. |
| 2003/0080120 | A1 | 5/2003 | Whitmore et al. |
| 2003/0185948 | A1 | 10/2003 | Garwood |
| 2003/0206997 | A1 | 11/2003 | Winkelman et al. |
| 2004/0101605 | A1 | 5/2004 | Sigel |
| 2005/0284865 | A1 | 12/2005 | Fogle et al. |
| 2006/0009339 | A1 | 1/2006 | Sleight et al. |
| 2006/0049190 | A1 | 3/2006 | Middleton |
| 2006/0096978 | A1 | 5/2006 | Lafferty et al. |
| 2006/0113300 | A1 | 6/2006 | Wnek et al. |
| 2006/0191929 | A1 | 8/2006 | Berg, Jr. et al. |
| 2007/0131742 | A1 | 6/2007 | Fitzwater |
| 2007/0131743 | A1 | 6/2007 | Fitzwater |
| 2007/0131744 | A1 | 6/2007 | Fitzwater |
| 2007/0131745 | A1 | 6/2007 | Fitzwater |
| 2007/0137222 | A1 | 6/2007 | Kastanek et al. |
| 2007/0138247 | A1 | 6/2007 | Fitzwater |
| 2007/0151888 | A1 | 7/2007 | Bossel et al. |
| 2007/0267466 | A1 | 11/2007 | Brand et al. |
| 2008/0308614 | A1 | 12/2008 | Fitzwater |
| 2009/0039077 | A1 | 2/2009 | Fitzwater |
| 2009/0214142 | A1 | 8/2009 | Bossel et al. |
| 2010/0046861 | A1 | 2/2010 | Wilcoxen |
| 2010/0263332 | A1 | 10/2010 | Files et al. |
| 2011/0017812 | A1 | 1/2011 | Belko et al. |
| 2011/0019942 | A1 | 1/2011 | Piraneo |
| 2011/0052106 | A1 | 3/2011 | Holmes et al. |
| 2011/0297680 | A1 | 12/2011 | Howell et al. |
| 2012/0224794 | A1 | 9/2012 | Veder |
| 2013/0068653 | A1 | 3/2013 | Lipinski |
| 2014/0016882 | A1 | 1/2014 | Fitzwater |
| 2015/0083789 | A1 | 3/2015 | Fitzwater et al. |
| 2016/0159516 | A1 | 6/2016 | Ball |

FOREIGN PATENT DOCUMENTS

| | | | |
|---|---|---|---|
| DE | 1 060 313 | | 6/1959 |
| DE | 203 00 817 | | 4/2003 |
| EP | 1 072 526 | | 1/2001 |
| EP | 1 424 290 | A2 | 6/2004 |
| EP | 1 452 458 | | 9/2004 |
| EP | 1 457 425 | | 9/2004 |
| EP | 1 798 159 | A1 | 6/2007 |
| EP | 1 964 785 | | 9/2008 |
| EP | 2 492 203 | A1 | 8/2012 |
| EP | 2 492 204 | A1 | 8/2012 |
| FR | 2 516 481 | | 5/1983 |
| FR | 2 665 882 | | 2/1992 |
| FR | 2 687 384 | | 8/1993 |
| GB | 2 365 000 | | 2/2002 |
| JP | 2004 224402 | | 8/2004 |
| JP | 2005-320022 | A | 11/2005 |
| JP | 2006-240671 | A | 9/2006 |
| JP | 2010-222050 | A | 10/2010 |
| JP | 2011-168330 | A | 9/2011 |
| JP | 2011-168331 | A | 9/2011 |
| JP | 2011-173640 | A | 9/2011 |
| JP | 2011-189978 | A | 9/2011 |
| JP | 2011-251774 | A | 12/2011 |
| JP | 2012-152901 | | 8/2012 |
| JP | 2012-533487 | | 12/2012 |
| WO | WO 2006/052326 | | 5/2006 |
| WO | WO 2007/067705 | | 6/2007 |
| WO | WO 2007/084525 | | 7/2007 |
| WO | WO 2008/086277 | | 7/2008 |
| WO | WO 2009/023286 | | 2/2009 |
| WO | WO 2011/011283 | | 1/2011 |
| WO | WO 2013/003149 | A | 1/2013 |

OTHER PUBLICATIONS

International Search Report and Written Opinion for PCT/US2014/057385 dated Jan. 30, 2015.

International Search Report and Written Opinion for PCT/US2016/043520 dated Oct. 28, 2016.

Supplementary Partial European Search Report for EP 14 84 9557 dated Mar. 7, 2017.

Supplementary European Search Report for EP 14 84 9557 dated Jun. 7, 2017.

International Search Report and Written Opinion for PCT/US2016/047521 dated Dec. 13, 2016.

Office Action for U.S. Appl. No. 14/496,252 dated May 14, 2015.

Amendment A and Response to Office Action for U.S. Appl. No. 14/496,252 dated Aug. 7, 2015.

Office Action for U.S. Appl. No. 14/496,252 dated Nov. 16, 2015.

Amendment B for U.S. Appl. No. 14/496,252 dated Dec. 22, 2015.

Office Action for U.S. Appl. No. 14/496,252 dated Apr. 13, 2016.

Response to Office Action for U.S. Appl. No. 14/496,252 dated Aug. 15, 2016.

Office Action for U.S. Appl. No. 14/496,252 dated Nov. 7, 2016.

Response to Office Action for U.S. Appl. No. 14/496,252 dated Feb. 7, 2017.

Notice of Allowance and Fee(s) Due for U.S. Appl. No. 14/496,252 dated May 25, 2017.

Issue Fee Transmittal Form for U.S. Appl. No. 14/496,252 dated Aug. 7, 2017.

Issue Notification for U.S. Appl. No. 14/496,252 dated Aug. 23, 2017.

Office Action for U.S. Appl. No. 15/217,026 dated Nov. 18, 2016.

Amendment A and Response to Office Action for U.S. Appl. No. 15/217,026 dated Feb. 17, 2017.

Office Action for U.S. Appl. No. 15/217,026 dated May 23, 2017.

(56) References Cited

OTHER PUBLICATIONS

Response to Final Office Action for U.S. Appl. No. 15/217,026 dated May 31, 2017.
Notice of Allowance and Fee(s) Due for U.S. Appl. No. 15/217,026 dated Jun. 9, 2017.
Issue Fee Transmittal Form for U.S. Appl. No. 15/217,026 dated Aug. 23, 2017.

REINFORCED PACKAGE

CROSS-REFERENCE TO RELATED APPLICATIONS

This application claims the benefit of U.S. Provisional Patent Application No. 62/354,270, filed Jun. 24, 2016. This application is a continuation-in-part of U.S. patent application Ser. No. 15/217,026, filed Jul. 22, 2016, which claims the benefit of U.S. Provisional Application No. 62/282,049, filed Jul. 23, 2015, and is a continuation-in-part of U.S. patent application Ser. No. 14/496,252, filed Sep. 25, 2014, which claims the benefit of U.S. Provisional Patent Application No. 61/960,712, filed Sep. 25, 2013.

INCORPORATION BY REFERENCE

The disclosures of U.S. Provisional Patent Application No. 62/354,270, filed Jun. 24, 2016, U.S. patent application Ser. No. 15/217,026, filed Jul. 22, 2016, U.S. Provisional Patent Application No. 62/282,049, filed Jul. 23, 2015, U.S. patent application Ser. No. 14/496,252, filed Sep. 25, 2014, U.S. Provisional Patent Application No. 61/960,712, filed on Sep. 25, 2013, U.S. patent application Ser. No. 15/209,013, filed Jul. 13, 2016, and U.S. Provisional Patent Application No. 62/231,723, filed on Jul. 14, 2015, are hereby incorporated by reference for all purposes as if presented herein in their entirety.

BACKGROUND OF THE DISCLOSURE

The present disclosure generally relates to reinforced packages for holding products and to methods of forming the packages. More specifically, the present disclosure is directed to a package including a bag or liner attached to a carton or blank having features to reinforce the shape of the formed package and allow access to the contents of the package, and features that facilitate forming the package and keeping the package open.

Bags or liners, such as paper or plastic bags, traditionally have been used for the packaging and transport of products from bulk materials such as rice or sand to larger items. Bags or liners generally are inexpensive and easy to manufacture and can be formed in different configurations and sizes, and can be used for storage and transport of a wide variety of products. In particular, in the food service industry, bags or liners are frequently used for packaging of prepared food items, such as sandwiches, French fries, cereal, etc. Currently, there is a growing demand for bags or liners or similar packages for use in packaging various products, including sandwiches, French fries, cereal, and other prepared food items, for presentation to consumers. However, it is equally important that the costs of such packages necessarily must be minimized as much as possible. While various packages designs including reinforcing or supporting materials have been developed, often, the manufacture of such specialty bags or liners having reinforcing layers or materials supplied thereto has required multiple stages or operations, which can significantly increase the cost of manufacture of such packages.

SUMMARY OF THE DISCLOSURE

In general, one aspect of the disclosure is generally directed to a reinforced package comprising a carton comprising a plurality of panels that extends at least partially around an interior of the carton. The plurality of panels can comprise a front panel, a first side panel foldably connected to the front panel along a first fold line, a back panel foldably connected to at least the first side panel along a second fold line, and a second side panel foldably connected to at least one of the front panel and the back panel. The reinforced package further can comprise a bag at least partially attached to the carton. The bag can have an at least partially open end, an at least partially closed end, and an interior space for holding a product. The carton can be positionable in a non-erect position wherein the interior space of the bag is at least partially collapsed and in an erect position wherein the interior space of the bag is increased. The carton can be configured to support the bag in the erect position. The first side panel and the second side panel can comprise retention features for at least partially retaining the carton in the erect position, and the retention features can comprise at least a V-shaped fold line extending from the first fold line and extending in the first side panel.

In another aspect, the disclosure is generally directed to, in combination, a carton blank and a bag for forming a reinforced package for holding a product. The carton blank can be for forming a carton and can comprise a plurality of panels comprising a front panel, a first side panel foldably connected to the front panel along a first fold line, a back panel foldably connected to at least the first side panel along a second fold line, and a second side panel foldably connected to at least one of the front panel and the back panel. The bag can have an at least partially open end, an at least partially closed end, and an interior space for holding a product. The bag can be at least partially attached to the carton blank. The reinforced package formed from the carton blank and the bag can be positionable in a non-erect position wherein the interior space of the bag is at least partially collapsed and in an erect position wherein the interior space of the bag is increased. The first side panel and the second side panel can comprise retention features for at least partially retaining the carton formed from the carton blank in the erect position, and the retention features can comprise at least a V-shaped fold line extending from the first fold line and extending in the first side panel.

In another aspect, the disclosure is generally directed to a method of forming a reinforced package comprising obtaining a carton blank at least partially attached to a bag. The carton blank can comprise a plurality of panels comprising a front panel, a first side panel foldably connected to the front panel along a first fold line, a back panel foldably connected to at least the first side panel along a second fold line, and a second side panel foldably connected to at least one of the front panel and the back panel. The bag can comprise an at least partially open end, an at least partially closed end, and an interior space for holding a product. The method further can comprise forming an interior of a carton at least partially defined by the plurality of panels by folding the plurality of panels at least partially around the bag. The carton can be positionable in a non-erect position wherein the interior space of the bag is at least partially collapsed and in an erect position wherein the interior space of the bag is increased. The carton can be configured to support the bag in the erect position. The first side panel and the second side panel can comprise retention features for at least partially retaining the carton in the erect position, and the retention features can comprise at least a V-shaped fold line extending from the first fold line and extending in the first side panel.

Other aspects, features, and details of the present disclosure can be more completely understood by reference to the following detailed description of exemplary embodiment taken in conjunction with the drawings and from the appended claims.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a reinforced package for holding products such as food products or other articles. Packages according to the present disclosure can accommodate articles of any shape. The packages can comprises a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths and can extend about or over the closed ends of the bags, in some embodiments enclosing such closed ends, and will provide support for the bags upon loading with a product or article or series of articles therein. In some embodiments, the reinforcing construct can be folded with their bags into a configuration supporting the bags in a freestanding, upright and opened condition for ease of loading and ease of use.

Figure 1:
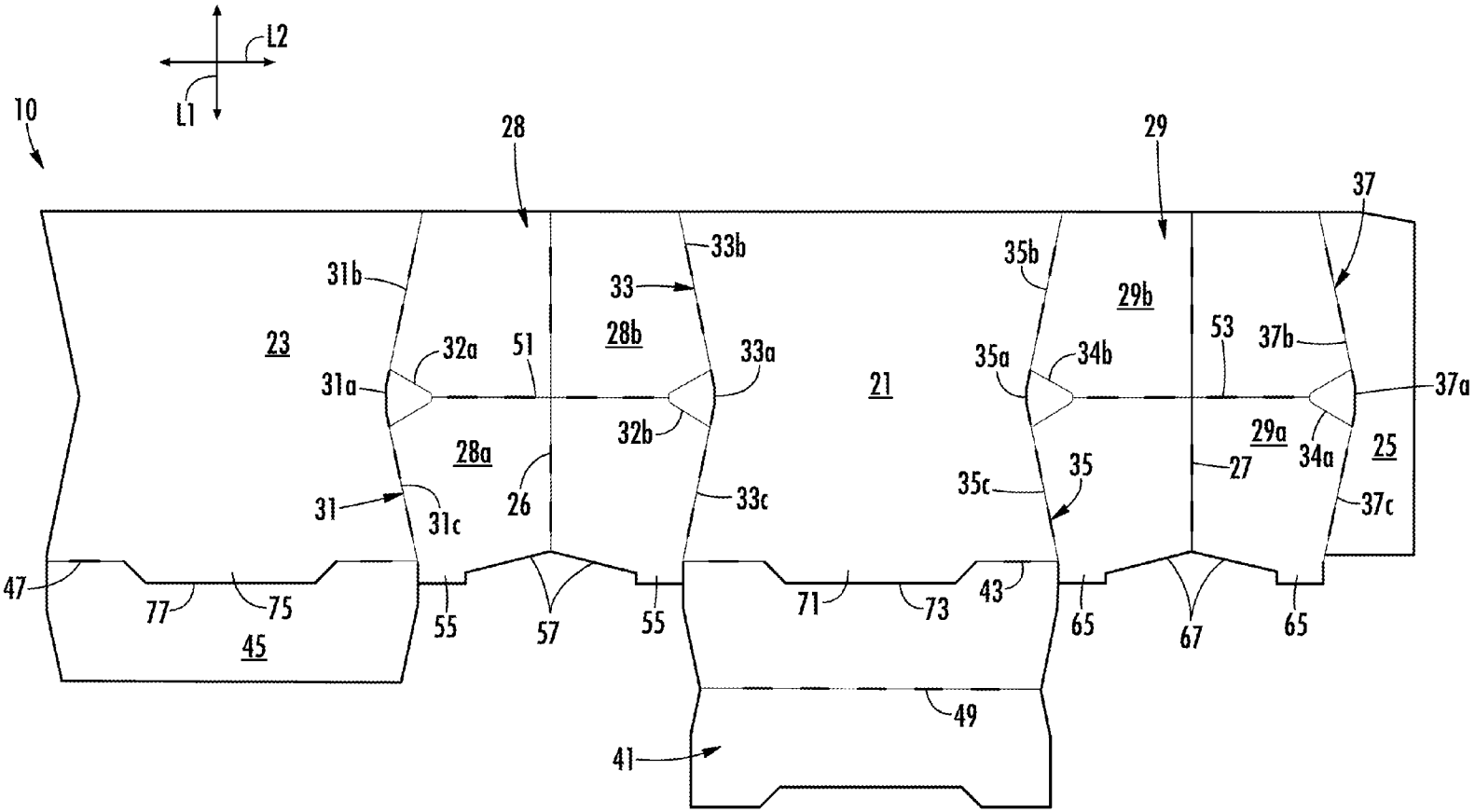
FIG. 1 is an exterior plan view of a blank used to form a carton of a package according to a first exemplary embodiment of the disclosure.

FIG. 1 illustrates a blank 10 for forming a reinforced package generally indicated at 1 (FIGS. 4 and 5), that includes a bag 3 attached to a carton 5 according to one embodiment of the disclosure. The bag 3 has an open top end 7 (FIG. 4), a closed or sealed bottom end 9 (FIG. 3), and an interior space 17 (FIG. 4) for holding a product. In one embodiment, the bag 3 has sealed sides 19 (FIGS. 3-5) extending the length of the bag between the top 7 and bottom 9. The reinforcing carton 5 has a bottom 20 that supports the sealed bottom 9 of the bag 3. The carton 5 has other features as further described herein to reinforce the package 1 by increasing the rigidity of the package 1 and to lock the package in the formed state of FIGS. 4 and 5. The carton 5 can facilitate forming the package 1 and keeping the package 1 open to allow access to the contents in the interior space 17 of the bag 3. Further, the bottom 20 of the carton 5 has support features for allowing the package 1 to be positioned in the upright position of FIGS. 4 and 5.

As shown in FIG. 1, the blank 10 has a lateral axis L1 and a longitudinal axis L2. In the illustrated embodiment, the blank 10 has a front panel 21 foldably connected to a first side panel 28 at a first fold line 33. The first side panel 28 includes two individual panel portions 28*a*, 28*b* foldably connected to one another at lateral fold line 26. A first back panel 23 is foldably connected to the first side panel 28 at a second fold line 31. A second side panel 29 is foldably connected to the front panel 21 at a third fold line 35. The second side panel 29 includes two individual panel portions 29*a*, 29*b* foldably connected to one another at lateral fold line 27. An attachment flap or second back panel 25 is foldably connected to the second side panel 29 at a fourth fold line 37. In the illustrated embodiment, the blank 10 includes a first bottom end flap or bottom panel 41 foldably connected to the front panel 21 at a longitudinal fold line 43 and a second bottom end flap 45 foldably connected to the first back panel 23 at a longitudinal fold line 47. In the illustrated embodiment, the first bottom end flap 41 includes a longitudinal fold line 49 (e.g., bottom fold line) extending across the width of the bottom end flap 41. Any of the front panel 21, the back panels 23, 25, the side panels 28, 29, the bottom end flaps 41, 45 could be omitted or could be otherwise arranged, shaped, positioned, and/or configured without departing from the disclosure.

Figure 1A:
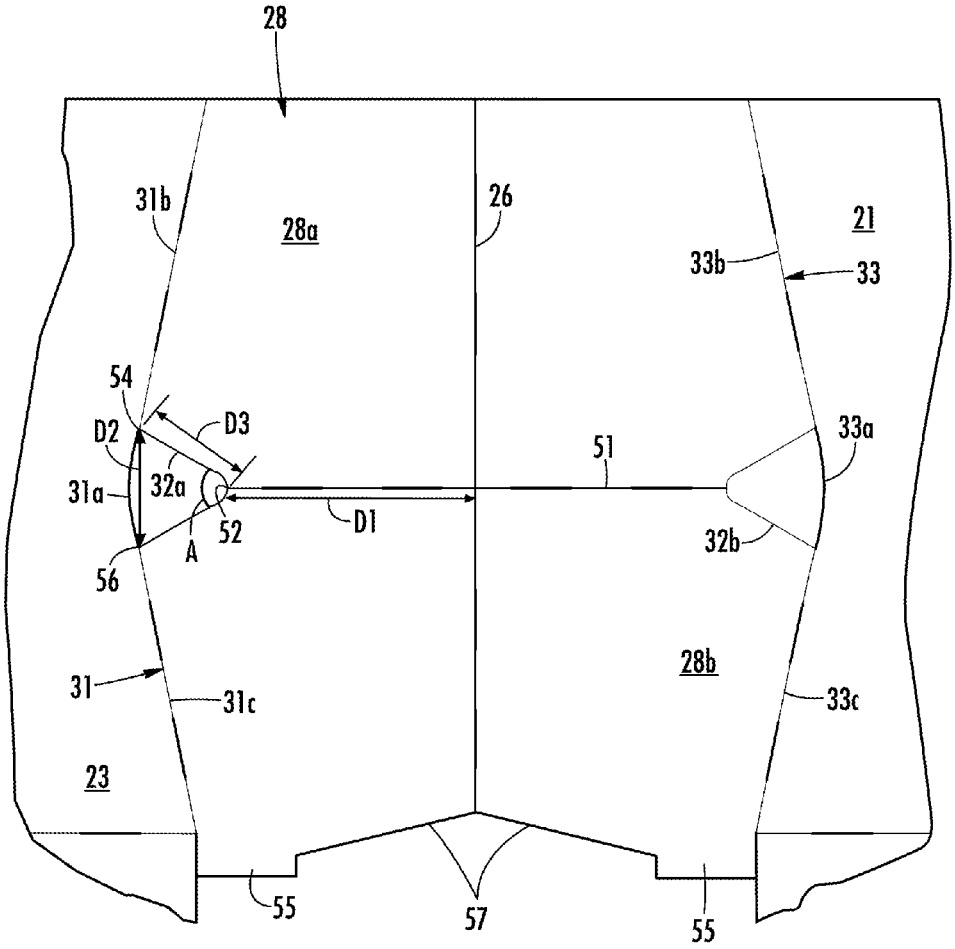
FIG. 1A is a detail view of a side panel of the blank of FIG. 1.

In one embodiment, the panel portions 28*a*, 28*b* of the first side panel 28 include a longitudinal fold line 51 extending between respective V-shaped fold lines 32*a*, 32*b* that abut the respective fold lines 31, 33. As shown in FIGS. 1 and 1A, the longitudinal fold line 51 extends from the vertex of the V-shaped fold line 32*a* to the vertex of the V-shaped fold line 32*b* and intersects with the lateral fold line 26. In the illustrated embodiment, the panel portions 29*a*, 29*b* of the second side panel 29 include a longitudinal fold line 53 extending between respective V-shaped fold lines 34*a*, 34*b* that abut the respective fold lines 35, 37. As shown in FIG. 1, the longitudinal fold line 51 extends from the vertex of the V-shaped fold line 34*a* to the vertex of the V-shaped fold line 34*b* and intersects with the lateral fold line 27. In one embodiment, each of the fold lines 31, 33, 35, 37 can be cut-crease style fold lines or any other suitable fold line. As shown in FIGS. 1 and 1A, the fold line 31 can include an arcuate cut portion 31*a* and two oblique portions 31*b*, 31*c* extending from the arcuate cut portion 31*a* to the respective top edge of the blank 10 and bottom flap 45. Similarly, the fold line 33 can include an arcuate cut portion 33*a* and two oblique portions 33*b*, 33*c*, the fold line 35 can include an arcuate cut portion 35*a* and two oblique portions 35*b*, 35*c*, and the fold line 37 can include an arcuate cut portion 37*a* and two oblique portions 37*b*, 37*c*. Alternatively, the arcuate cut portions could be other suitable features (e.g., arcuate creases and/or alternatively shaped) without departing from the disclosure.

As shown in FIG. 1A, the V-shaped fold line 32*a* can include a vertex 52 and two spaced ends 54, 56 opposite to the vertex 52. In one embodiment, the vertex 52 can be spaced apart from the lateral fold line 26 by a distance D1 (e.g., a longitudinal distance), the ends 54, 56 can be spaced apart from one another by a distance D2 (e.g., a lateral distance), and each of the ends 54, 56 can be spaced apart from the vertex 52 by a distance D3 (e.g., an oblique distance). Stated another way, the distance D3 is the length of each of the sides of the V-shaped fold line 32*a*. In the illustrated embodiment, the sides of the V-shaped fold line 52 can extend at an angle A with respect to one another. In one exemplary embodiment, one or both of the distances D2, D3 can be less than the distance D1 (e.g., the distances D2, D3 could be less than or approximately equal to half the distance D1 in one example) so that the V-shaped fold line 32*a* is relatively small compared to the remainder of the panel portion 28*a*. Also, in an exemplary embodiment, the angle A could be approximately 60 degrees. Alternatively, the distances D1, D2, D3 could have any suitable relative dimensions and/or the angle A could be any suitable angle. As shown in FIG. 1A, the end 54 of the V-shaped fold line 32*a* can intersect with the respective ends of the arcuate cut portion 31*a* and the oblique portion 31*b* of the fold line 31, and the V-shaped fold line 32*a* could be continuous with the oblique portion 31*b* so that the end 54 could be considered a corner in one embodiment. Similarly, as shown in FIG. 1A, the end 56 of the V-shaped fold line 32*a* can intersect with the respective ends of the arcuate cut portion 31*a* and the oblique portion 31*c* of the fold line 31, and the V-shaped fold line 32*a* could be continuous with the oblique portion 31*c* so that the end 56 could be considered a corner in one embodiment. In the illustrated embodiment, the other V-shaped fold lines 32*b*, 34*a*, 34*b* are similarly configured to the V-shaped fold line 32*a*.

In one embodiment, the fold lines 26, 27, 31, 32*a*, 32*b*, 33, 34*a*, 34*b*, 35, 37, 51, and 53 comprise strengthening features of the blank that strengthen and reinforce the package 1 formed from the blank by increasing the rigidity of the sides of the carton 5. For example, in one embodiment, the strengthening features can help retain the package in the erected or expanded configuration shown in FIGS. 4 and 5 as described in more detail below. Any of the fold lines 26, 27, 31, 32*a*, 32*b*, 33, 34*a*, 34*b*, 35, 37, 51, 53 and the side panels 28, 29 could be omitted and/or could be otherwise arranged, shaped, positioned, and/or configured without departing from the disclosure.

Figure 4:
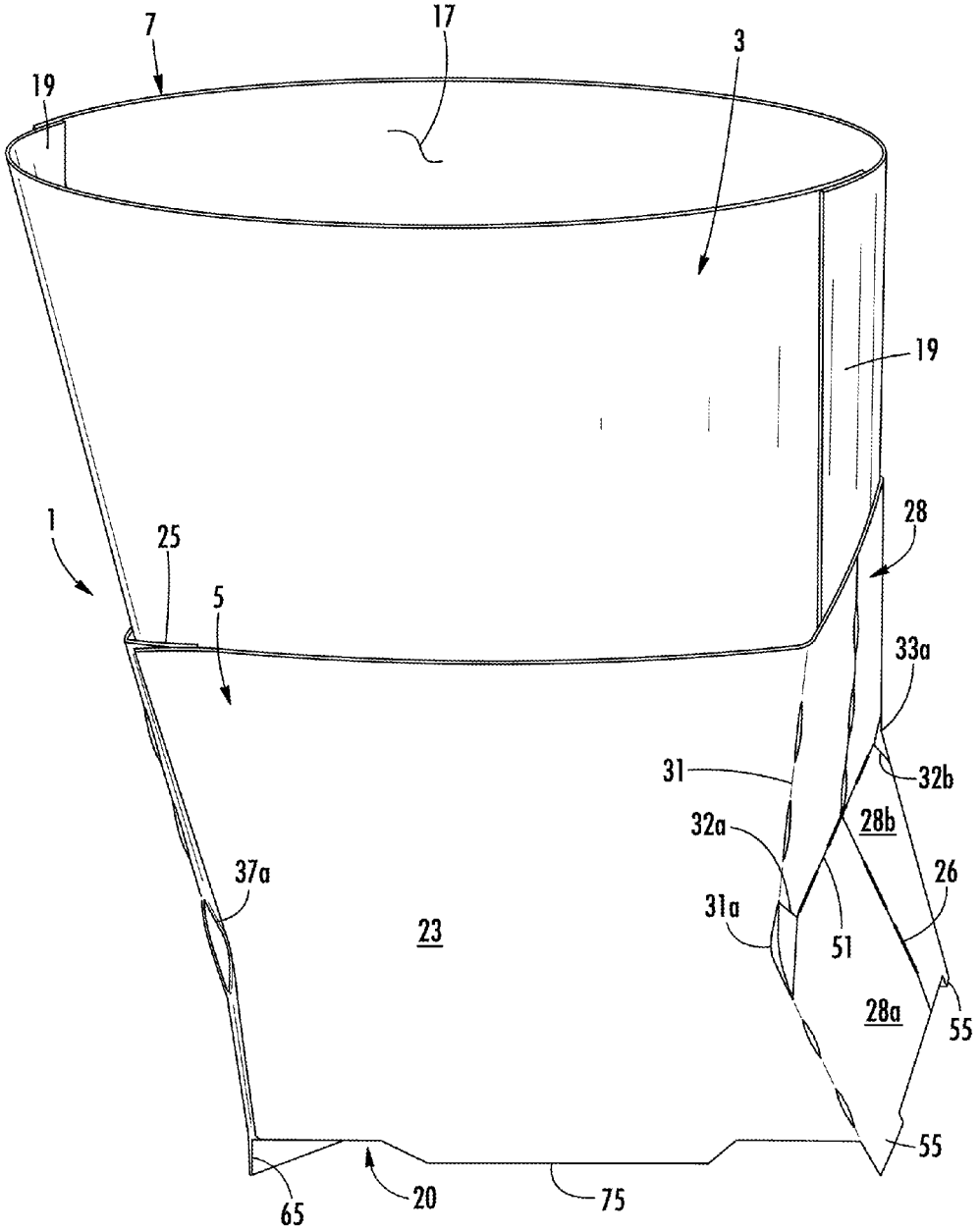
FIGS. 4 and 5 are perspective views of the package formed from the carton blank and bag of FIG. 3 according to the first exemplary embodiment of the disclosure.
Figure 5:
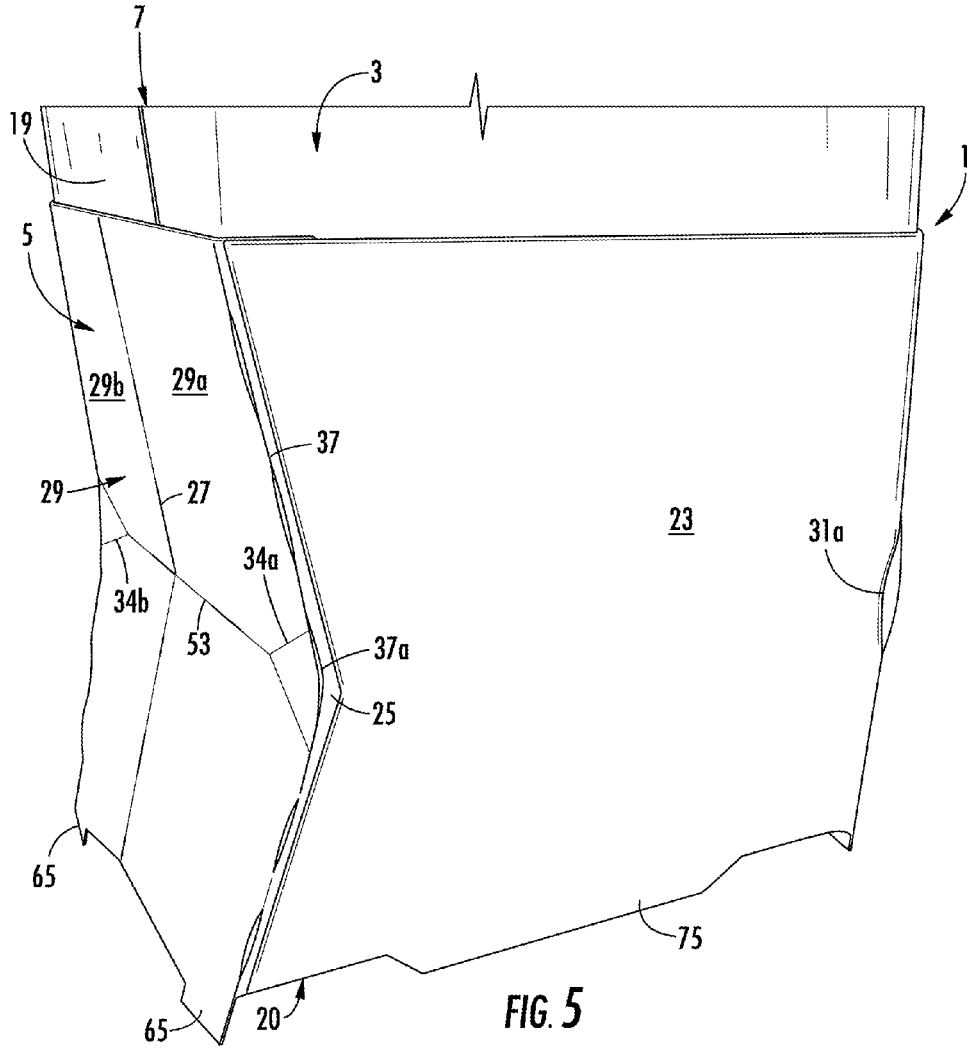

In one embodiment, each of the panel portions 28*a*, 28*b* of the side panel 28 includes a lower edge having a support or extension 55 adjacent a respective fold line 31, 33 and an oblique edge 57 extending from the support to the lateral fold line 26. Similarly, the panel portions 29*a*, 29*b* of the side panel 29 each have a support or extension 65 and oblique edges 67. The front panel 21 has a support or extension 71 defined by a cut 73 that extends between respective ends of the fold line 43. Similarly, the first back panel 23 has a support or extension 75 that is defined by a cut 77 that extends between respective ends of the fold line 47. As shown in FIGS. 4 and 5, the supports 55, 65, 71, 75 form the bottom 20 of the carton 5 that supports the formed package 1 on a surface in an upright position such that the open top end 7 of the bag 3 is accessible to provide access to the interior 17 of the bag.

Figure 2:
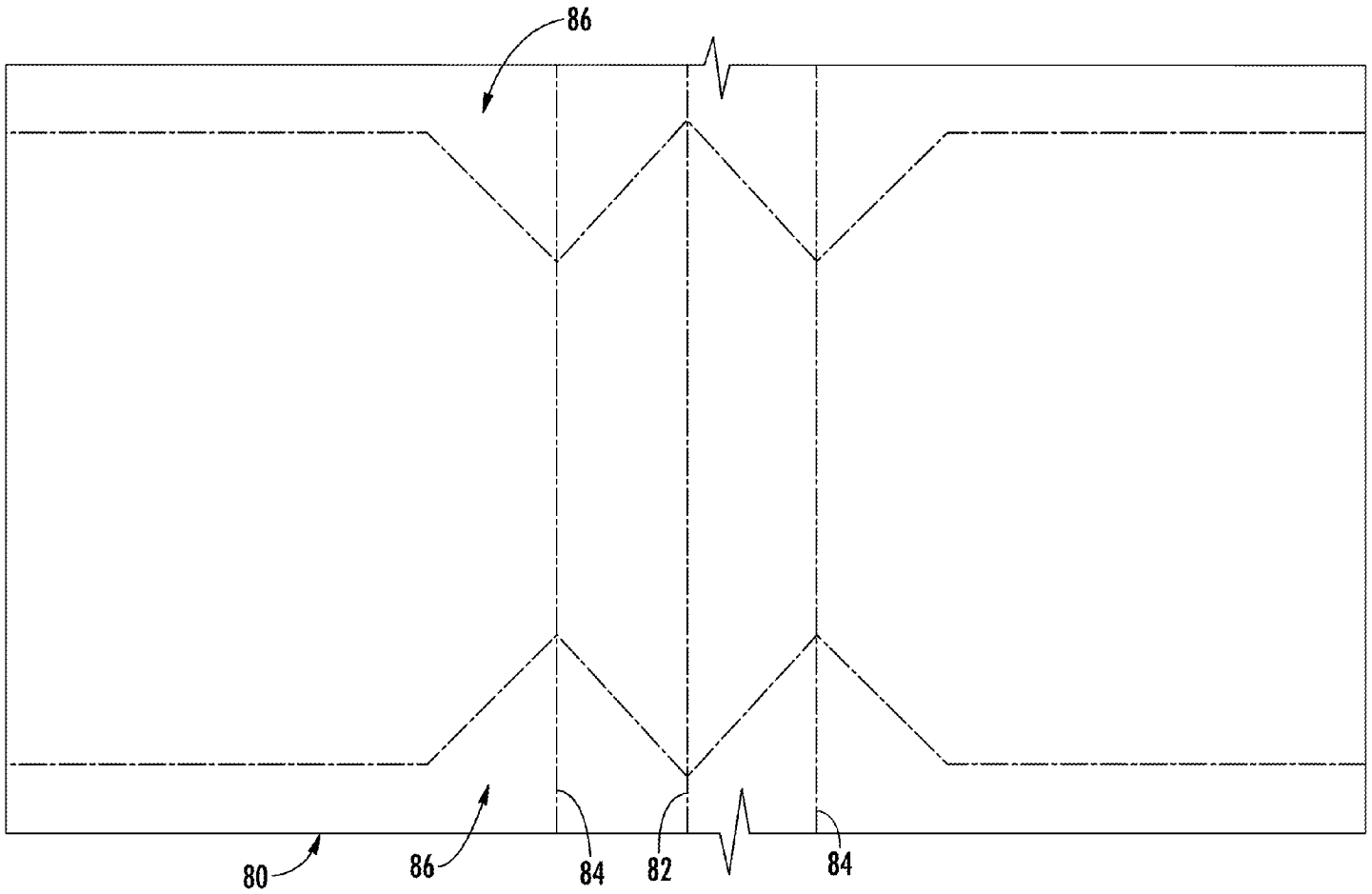
FIG. 2 is a plan view of a portion of a web for forming a bag of the package according to the first exemplary embodiment of the disclosure.

In one embodiment, the bag 3 (FIGS. 3-5) can be formed from similar methods and have similar features as the bag shown in U.S. Provisional Patent Application No. 62/231,723 filed Jul. 14, 2015, and U.S. patent application Ser. No. 15/209,013 filed Jul. 13, 2016, which are incorporated by reference herein. The bag 3 can be formed by a portion of suitable material 80 shown in FIG. 2 that has a central fold 82 and two outer folds 84 that form the gusseted bottom 9 of the bag 3. In addition, the portion 80 of bag material can have two edge margins 86 extending along the length of the portion 80 as indicated by the dashed lines in FIG. 2. When the gusseted bottom 9 of the bag 3 is formed, the central fold 82 and the two outer folds 84 form four layers of overlapped material at the bottom of the bag such that the bottom of the bag is expandable to accommodate various sizes of product to be held in the bag when the carton 5 is formed to the erected position of the package 1. The portion 80 of bag material is folded at the central fold 82 and outer folds 84 and the overlapping portion s of the edge margins 86 can be sealed together (e.g., heat sealed or otherwise secured together) to form the sealed sides 19 that extend into the bottom 9 of the bag so that the side portions of the overlapped layers of material in the bag 3 are sealed. In the flat configuration of the bag 3 (FIG. 3), the outer folds 84 form the lowermost edge of the bag. In one embodiment, the material for forming the bags 3 can include preprinted paper, polyethylene or other material including flexible and heat-sealable materials. The bag 3 could be otherwise shaped, arranged, and/or configured without departing from the disclosure. Further, the bag 3 could be otherwise formed without departing from the disclosure.

In one embodiment, the reinforced package 1 can be formed by similar systems and methods as shown in one or more of the incorporated by reference patent applications, wherein the packaging system attaches a web of material for forming the bags 3 of the packages 1 to the blanks 10, and the blanks and web move through a respective packaging system and are formed into the individual packages by various portions and components of the system. The blanks 10 are formed into the reinforced cartons 5 and the web of material is formed into the bags 3, with respective portions 80 of the web of material being overlapped to form the bags. The reinforced packages 1 include the reinforced carton 5 having a bag 3 attached.

Figure 3:
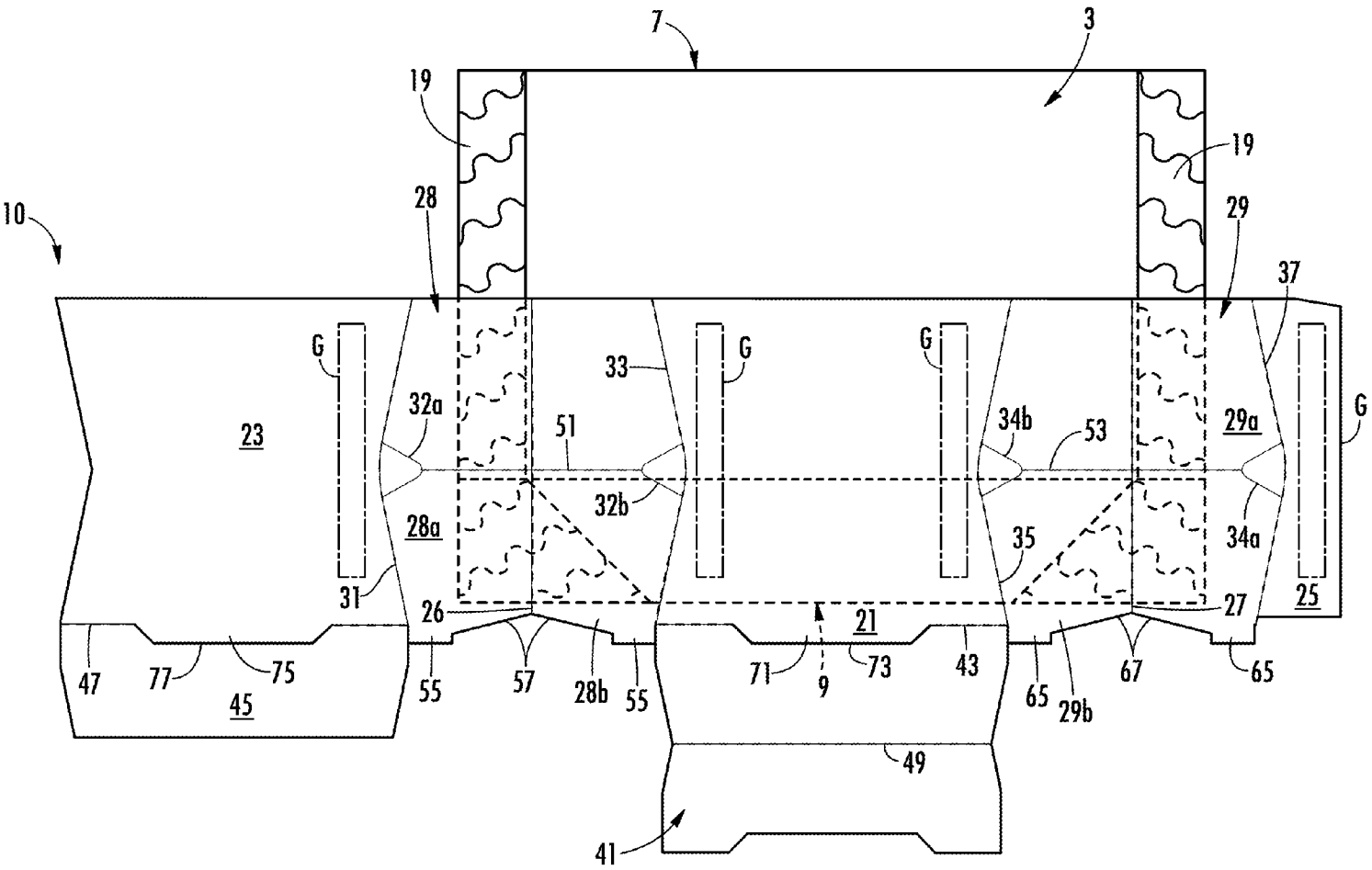
FIG. 3 is an exterior plan view showing the bag formed from the web portion of FIG. 2 attached to the interior of the carton blank of FIG. 1.

In one embodiment, the separated individual blanks 10 and attached bags 3 are conveyed in the system to a folder/gluer carton forming assembly that includes a series of folders that position the various flaps and panels of the blank 10 to form the flat cartons 5 that can be packaged and shipped for filling with product. In the illustrated embodiment, the bag 3 can be attached to the front panel 21 of the blank 10 (e.g., at glue areas G in the front panel 21) as shown in FIG. 3. The blank 10 can be folded along the lateral fold lines 26, 27 so that the back panel 23 and the attachment flap 25 at least partially overlap the bag 3 and the front panel 21. In addition, the side portions 28*a*, 29*a* can overlap the side portions 28*b*, 29*b* in the respective side panels 28, 29. In one embodiment, the bag 3 can be glued to the back panel 23 and the attachment flap 25 (e.g., by glue areas G in the respective back panel 23 and attachment flap 25). Accordingly, the bag 3 can be attached to front panel 21, the back panel 23, and the attachment flap 25 of the carton 5. In the illustrated embodiment, the attachment flap 25 can be overlapped with the back panel 23 and adhesively attached thereto. Also, the first bottom end flap 41 can be folded along the longitudinal fold line 49 to overlap the second bottom end flap 45 and the bottom end flaps 41, 45 can be adhesively attached together to form the closed bottom 20 of the carton. The package 1 could be otherwise formed without departing from the disclosure.

In the illustrated embodiment, the package 1 can be positioned to the erected configuration shown in FIGS. 4 and 5 by grasping the side panels 28, 29 and pushing the sides inward at fold lines 26, 27, causing the front panel 21 and back panel 23 to separate or move away from each other to give the package its three dimensional shape and form the interior space 17 of the bag 3 for holding a product. In the erect configuration of the package 1, the supports 55, 65, 71, 75 form the lowermost portion of the bottom 20 of the carton 5 so that the package 1 can be supported on a flat surface and positioned upright in the erect configuration to allow access to the interior space 17 through the top 7 of the bag 3 (FIG. 4). In one exemplary embodiment, the sealed bottom 9 of the bag 3 can be a water-tight seal that allows a user to add water or milk to the interior 17 of the bag of the reinforced package 1 to combine with a food product (e.g., cereal, oatmeal, etc.) in the interior. The package 1 can be placed in a microwave oven to heat the food product without departing from the disclosure. Further, the package 1 can be used to hold other types of food products without departing from the disclosure. In the flat configuration of the package 1, the carton 5 is folded flat by folding the side panels 28, 29 along fold lines 26, 27 and folding the bottom 20 at fold line 49 in the first bottom end flap 41.

In one embodiment, the fold lines 51, 26 in the side panel 28 and the fold lines 53, 27 in the side panel 29 can help increase the rigidity of the formed package 1. Also, the fold lines 26, 27, 31, 33, 35, 37, 51, 53 and the V-shaped fold lines 32*a*, 32*b*, 34*a*, 34*b* can be configured to allow the side panels 28, 29 to shape open and remain open. Stated another way, the fold lines 26, 31, 33, 51 and the V-shaped fold lines 32*a*, 32*b* of the first side panel 28 and the fold lines 27, 35, 37, and the V-shaped fold lines 34*a*, 34*b* of the second side panel 29 can help the side panels 28, 29 deform and/or fold inwardly according to a predetermined shape that helps retain the carton 5 in the expanded configuration by resisting forces that would tend to push the panels 28, 29 outwardly and collapse the carton 5. As shown in FIGS. 4 and 5, each of the side panels 28, 29 can include an upper portion that extends upwardly and outwardly (e.g., away from the interior of the carton 5) from the respective longitudinal fold lines 51, 52 and the respective V-shaped fold lines 32*a*, 32*b* and 34*a*, 34*b*. Accordingly, the side panels 28, 29 can bow inwardly (e.g., at least at the longitudinal fold lines 51, 52) to reinforce the structure of the carton 5 so that the package 1 is urged to stay in the erected configuration once formed.

In the illustrated embodiment, the V-shaped fold lines 32*a*, 32*b*, 34*a*, 34*b* are aligned with the respective arcuate cut portions 31*a*, 33*a*, 37*a*, 35*a* at the edges of the side panels 28, 29. The cut portions 31*a*, 33*a*, 35*a*, 37*a* and V-shaped fold lines 32*a*, 32*b*, 34*b*, 34*a* can help to create a relief tension in the side panels 28, 29 that facilitates positioning the package 1 in the open position and resists movement of the side panels 28, 29 from the open position of the package 1 when pressure is applied to the package. As shown in FIGS. 4 and 5, when the package 1 is formed, the arcuate cut portions 31*a*, 33*a*, 35*a*, 37*a* can form openings in the carton 5 when the side panels 28, 29 are positioned relative to the front panel 21 and back panel 23. The package 1, carton 5, blank 10, and/or bag 3 could have other features, or be otherwise shaped, arranged, and/or configured without departing from the disclosure.

Figure 6:
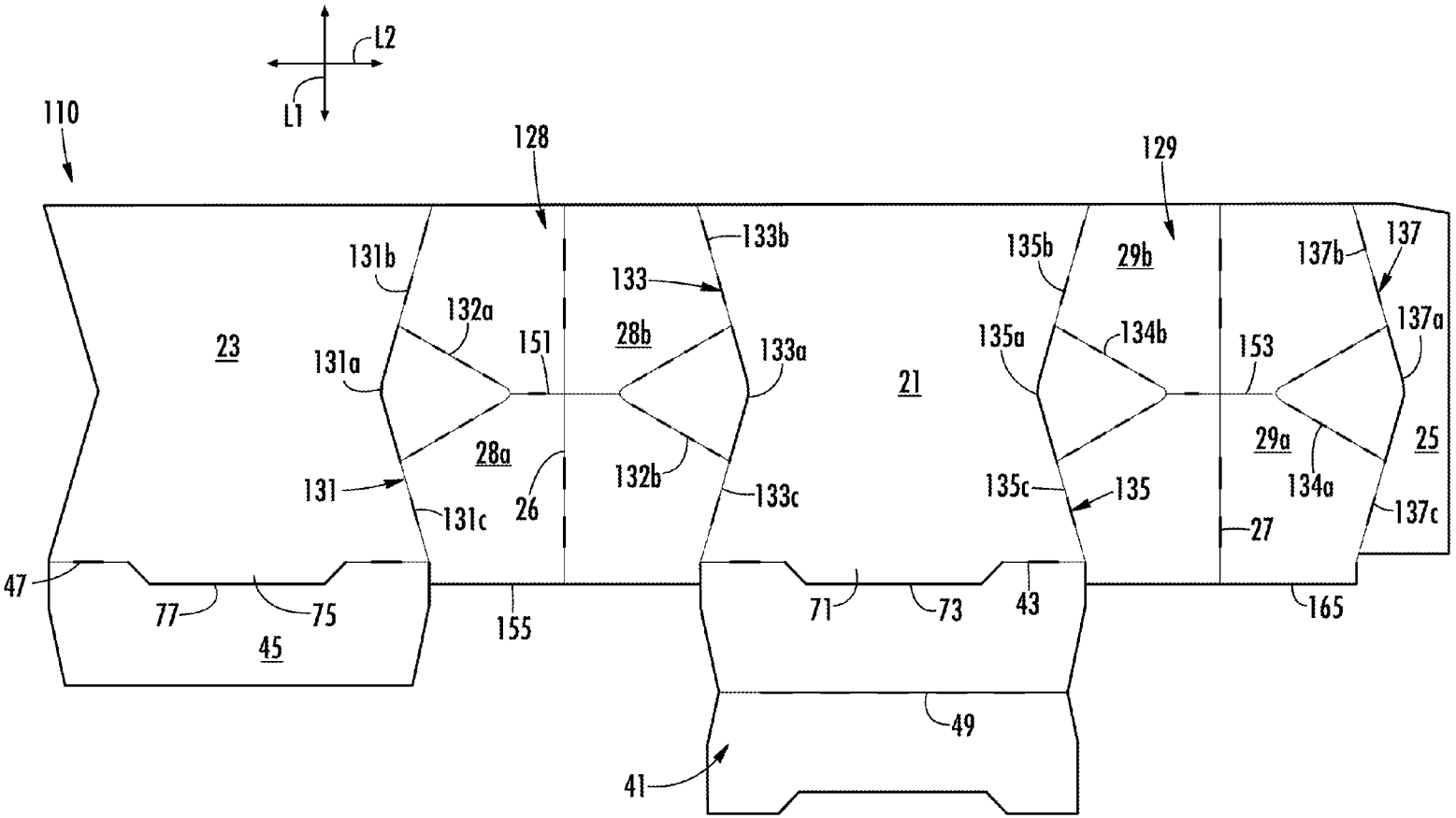
FIG. 6 is an exterior plan view of a blank used to form a carton of a package according to a second exemplary embodiment of the disclosure.

FIG. 6 is a plan view of a blank 110 for forming a construct 105 (FIGS. 8 and 9) of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 6, the blank 110 is similar to the blank 10 of the first embodiment except that the V-shaped fold lines 132*a*, 132*b*, 134*a*, 134*b* of the side panels 128, 129 of the second embodiment are larger than the V-shaped fold lines 32*a*, 32*b*, 34*a*, 34*b* in the side panels 28, 29 of the first embodiment (as shown in FIGS. 1 and 1A). Accordingly, the longitudinal fold lines 151, 153 extending between the respective V-shaped fold lines 132*a*, 132*b* and 134*a*, 134*b* in the side panels 128, 129 of the blank 110 are shorter than the fold lines 51, 53 of the blank 10 of the first embodiment. In addition, the fold line 131 can have a larger arcuate cut portion 131*a* and shorter oblique portions 131*b*, 131*c* in the second embodiment. Similarly, the fold line 133 can have a lager arcuate cut portion 133*a* and shorter oblique portions 133*b*, 133*c* in the second embodiment, the fold line 135 can have a lager arcuate cut portion 135*a* and shorter oblique portions 135*b*, 135*c* in the second embodiment, and the fold line 137 can have a lager arcuate cut portion 137*a* and shorter oblique portions 137*b*, 137*c* in the second embodiment.

Figure 6A:
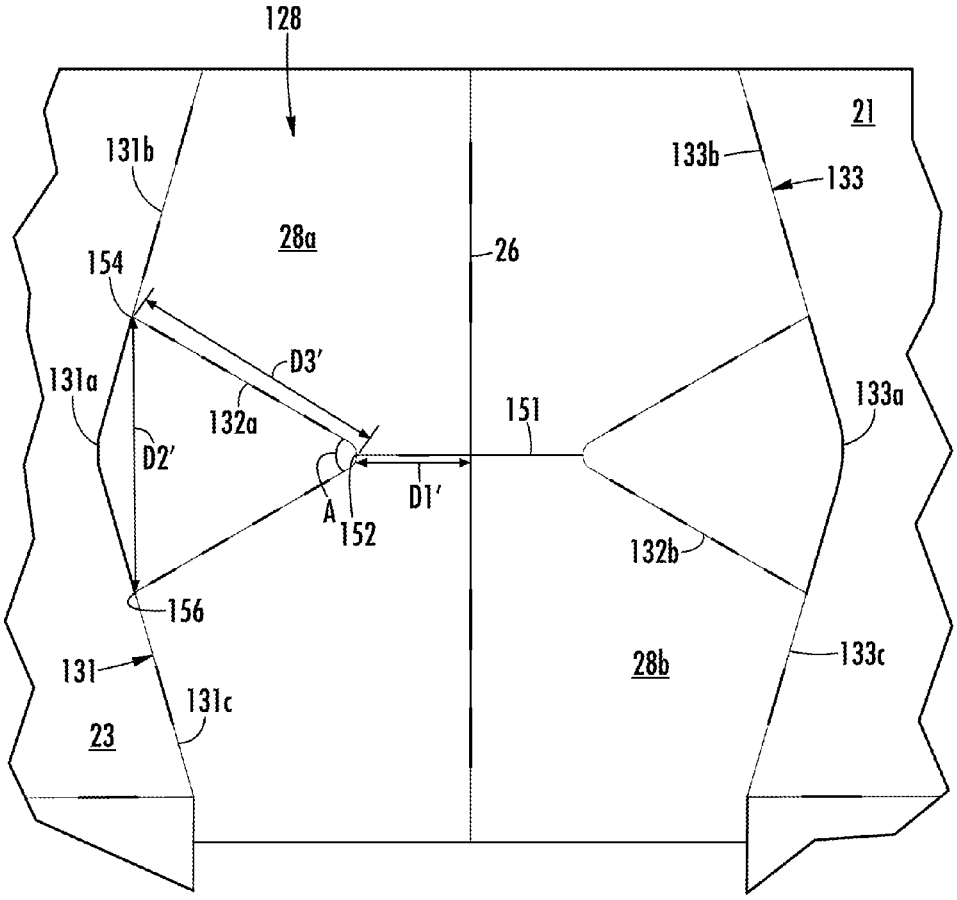
FIG. 6A is a detail view of a side panel of the blank of FIG. 6.

As shown in FIG. 6A, the vertex 152 of the V-shaped fold line 132*a* can be spaced from the lateral fold line 26 by a distance D1' (e.g., a longitudinal distance), the ends 154, 156 of the V-shaped fold line 132*a* can be spaced from one another by a distance D2' (e.g., a lateral distance), and each of the ends 154, 156 can be spaced apart from the vertex 152 by a distance D3' (e.g., an oblique distance). In addition, the sides of the V-shaped fold line can extend at an angle A with respect to one another. In the illustrated embodiment, the V-shaped fold line 132*a* can be configured similarly to the V-shaped fold line 32*a* of the first embodiment, except that the distance D3' is larger than the distance D1' (e.g., the distance D3' could be at least twice as long as the distance D1') so that the V-shaped fold line 132*a* is relatively large compared to the overall width of the panel portion 28*a*. In one embodiment, the distance D2' can be similar to the distance D3'. In an exemplary embodiment, the angle A could be approximately 60 degrees. Alternatively, the distances D1', D2', D3' could have any suitable relative dimensions and/or the angle A could be any suitable angle. The other V-shaped fold lines 132*b*, 134*a*, 134*b* are similarly configured to the V-shaped fold line 132*a* in the illustrated embodiment. Any of the V-shaped fold lines 132*a*, 132*b*, 134*a*, 134*b* and the fold lines 26, 27, 131, 133, 135, 137, 151, 153 could be otherwise shaped, arranged, and/or configured without departing from the disclosure.

Figure 8:
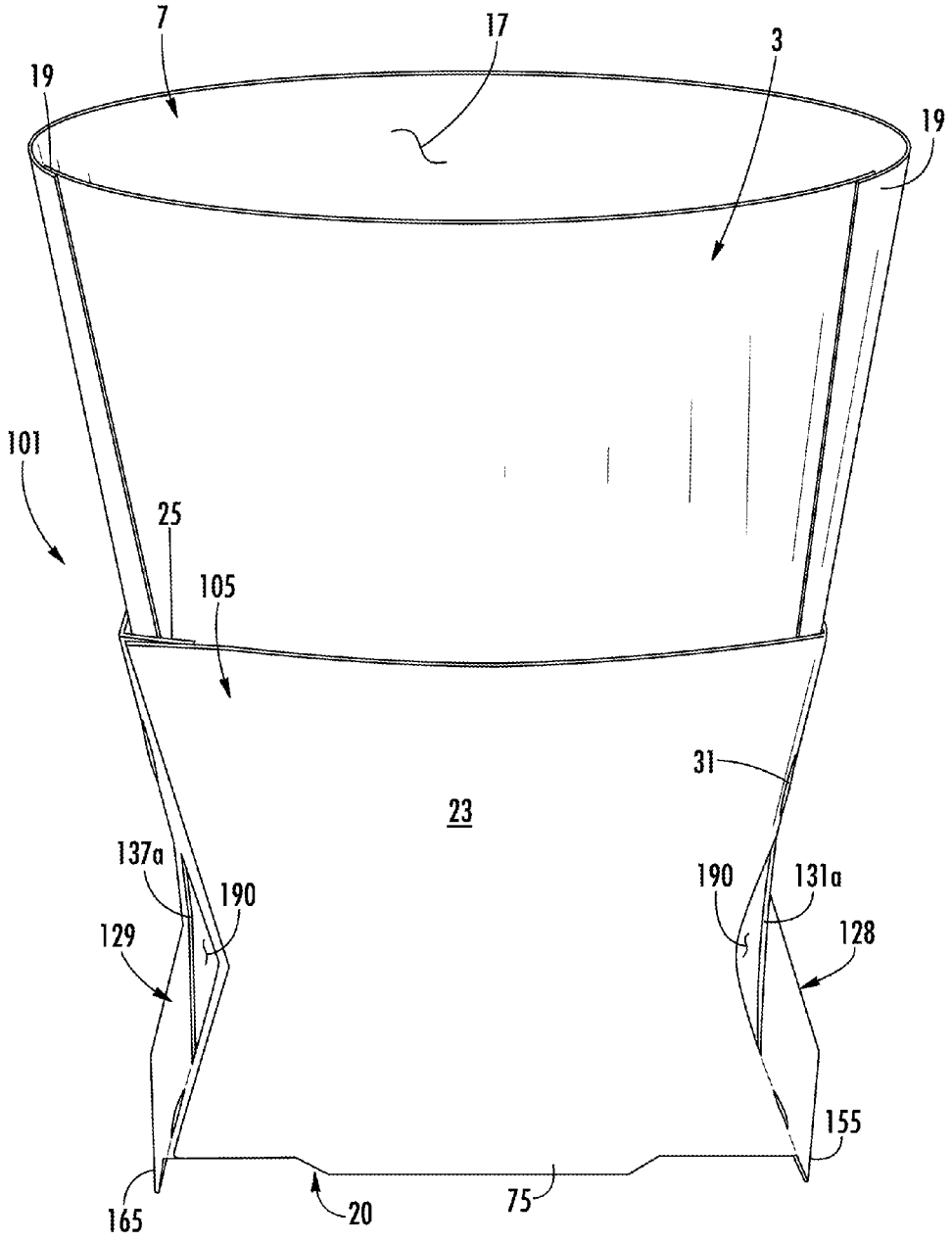
FIGS. 8 and 9 are perspective views of the package formed from the carton blank and bag of FIG. 7 according to the second exemplary embodiment of the disclosure.
Figure 9:
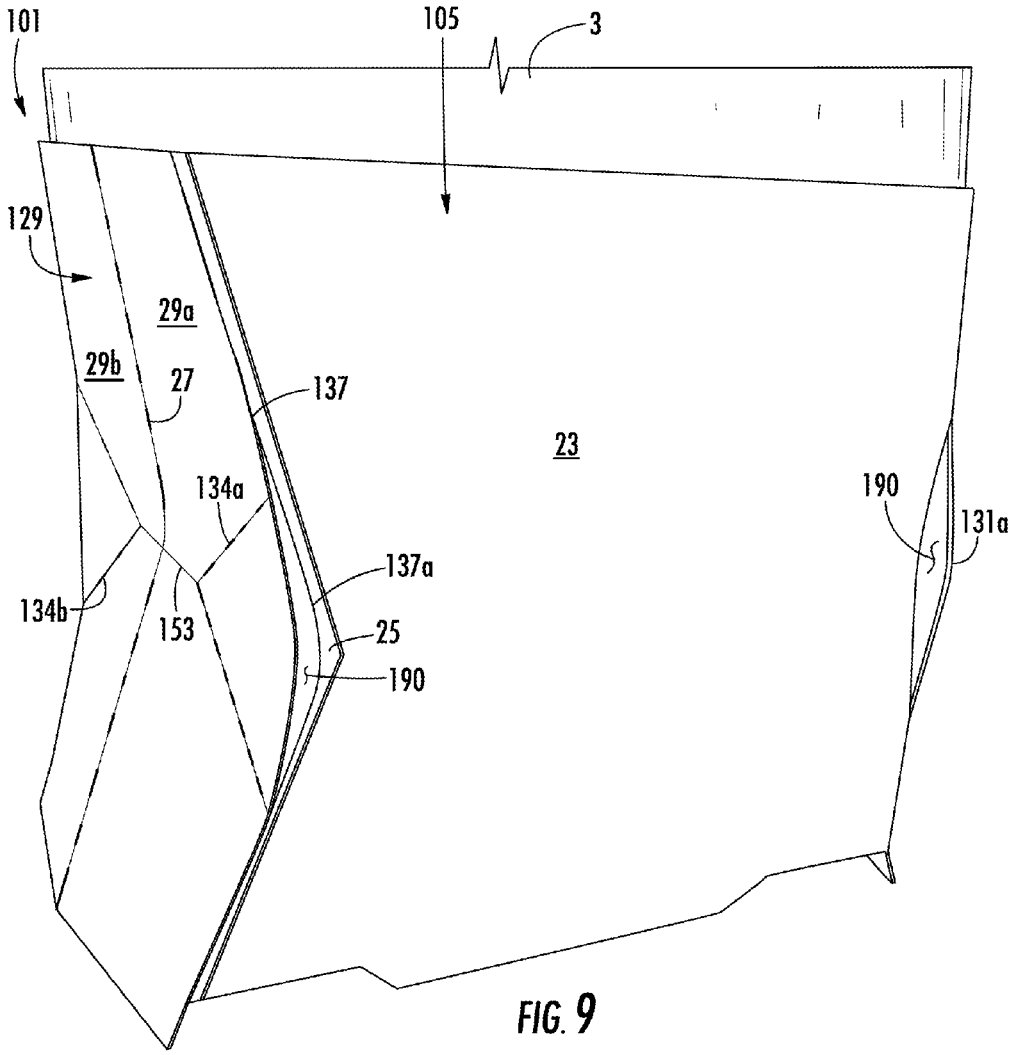

As shown in FIG. 6, the supports 55, 57 of the side panels 28, 29 of the first embodiment are omitted in the second embodiment. The side panels 128, 129 can have longitudinal support edges 155, 165, respectively. In one embodiment, the support edges 155, 165 can generally line up with the supports 71, 75 to help support the package 101 in the erect configuration (FIGS. 8 and 9). The side panels 128, 129, including the support edges 155, 165, could be otherwise shaped, arranged, and/or configured without departing from the disclosure.

Figure 7:
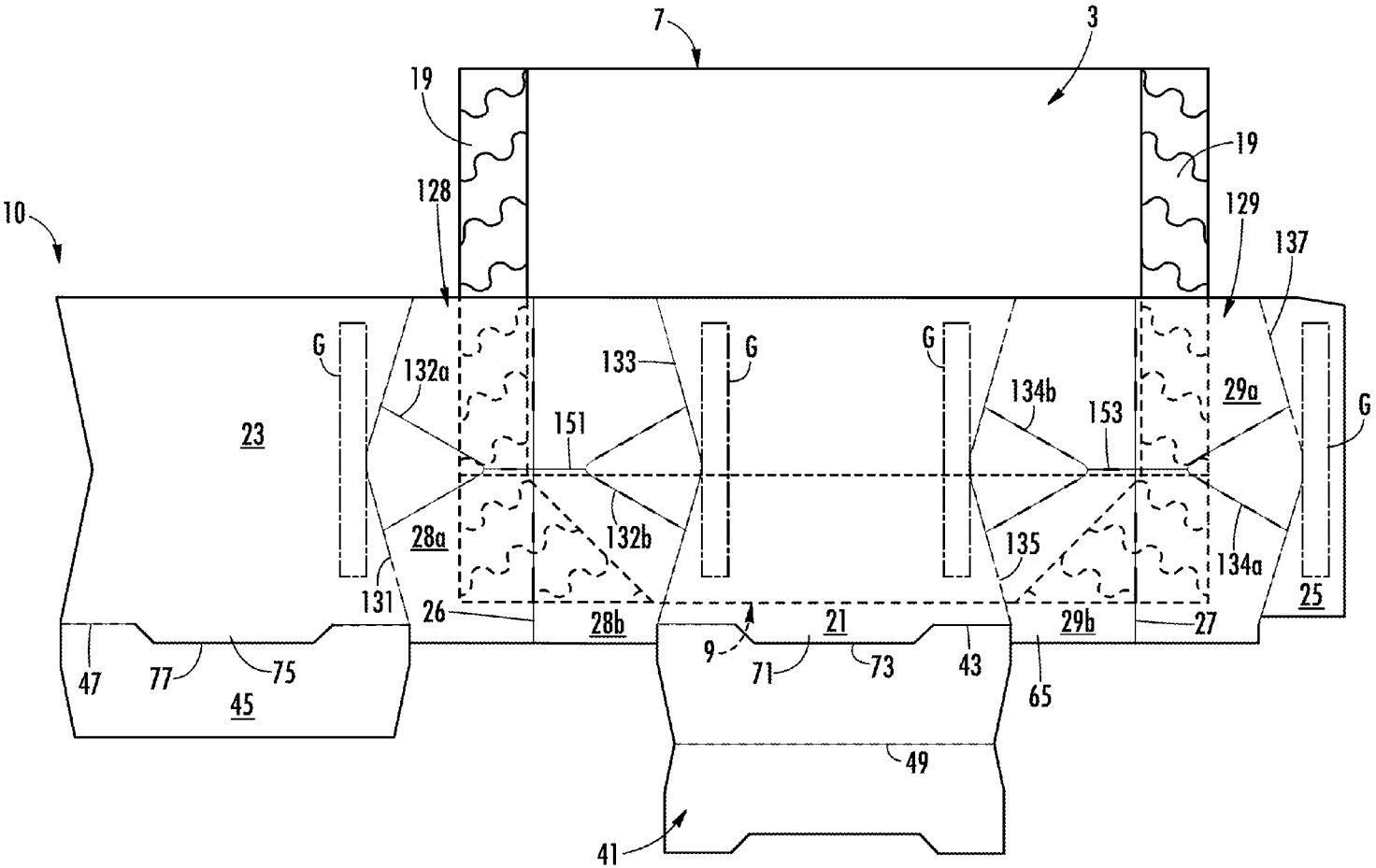
FIG. 7 is an exterior plan view showing the bag formed from the web portion of FIG. 2 attached to the interior of the carton blank of FIG. 6.

As shown in FIG. 7, the bag 3 can be glued to the blank 110 with glue areas G in a similar manner as described in the first embodiment. However, in the second embodiment, the bag 3 can at least partially overlap all of the V-shaped fold lines 132*a*, 132*b*, 134*a*, 134*b* before the blank 110 is folded to form the carton 105. In contrast, the bag 3 is spaced from the V-shaped fold lines 32*a*, 34*a* in the first embodiment (FIG. 3).

The erected package 110 with the bag 3 and the carton 105 is shown in FIGS. 8 and 9. As shown in FIGS. 8 and 9, in one embodiment, the side panels 128, 129 can partially separate from the front panel 21 and the respective back panels 23, 25 along the arcuate cut portions 133*a*, 135*a*, 131*a*, 137*a* to form respective openings 190. The package 101, including the carton 105 and the bag 3, could be otherwise shaped, arranged, and/or configured without departing from the disclosure.

Figure 10:
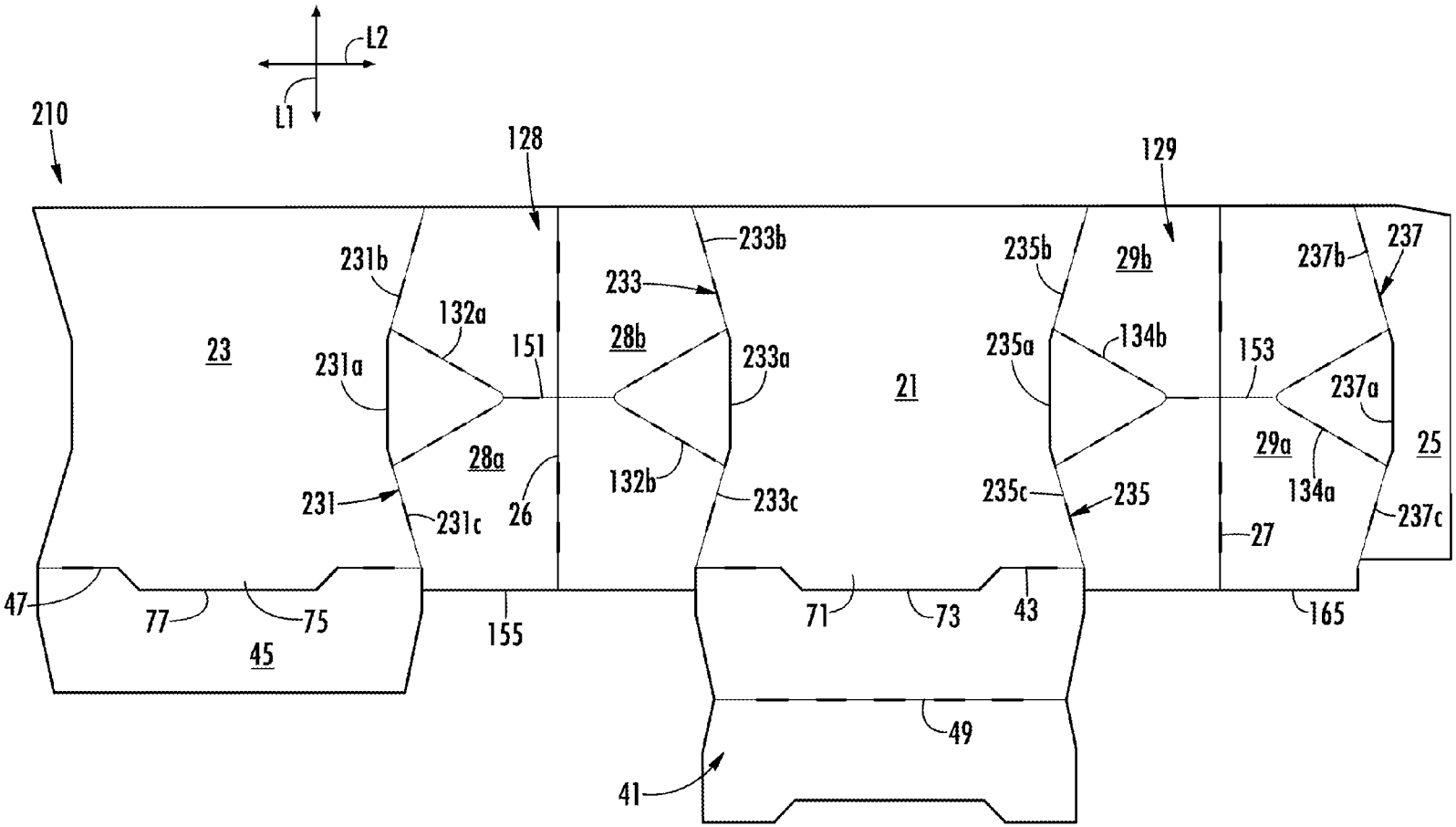
FIG. 10 is an exterior plan view of a blank used to form a carton of a package according to a third exemplary embodiment of the disclosure.
Figure 11:
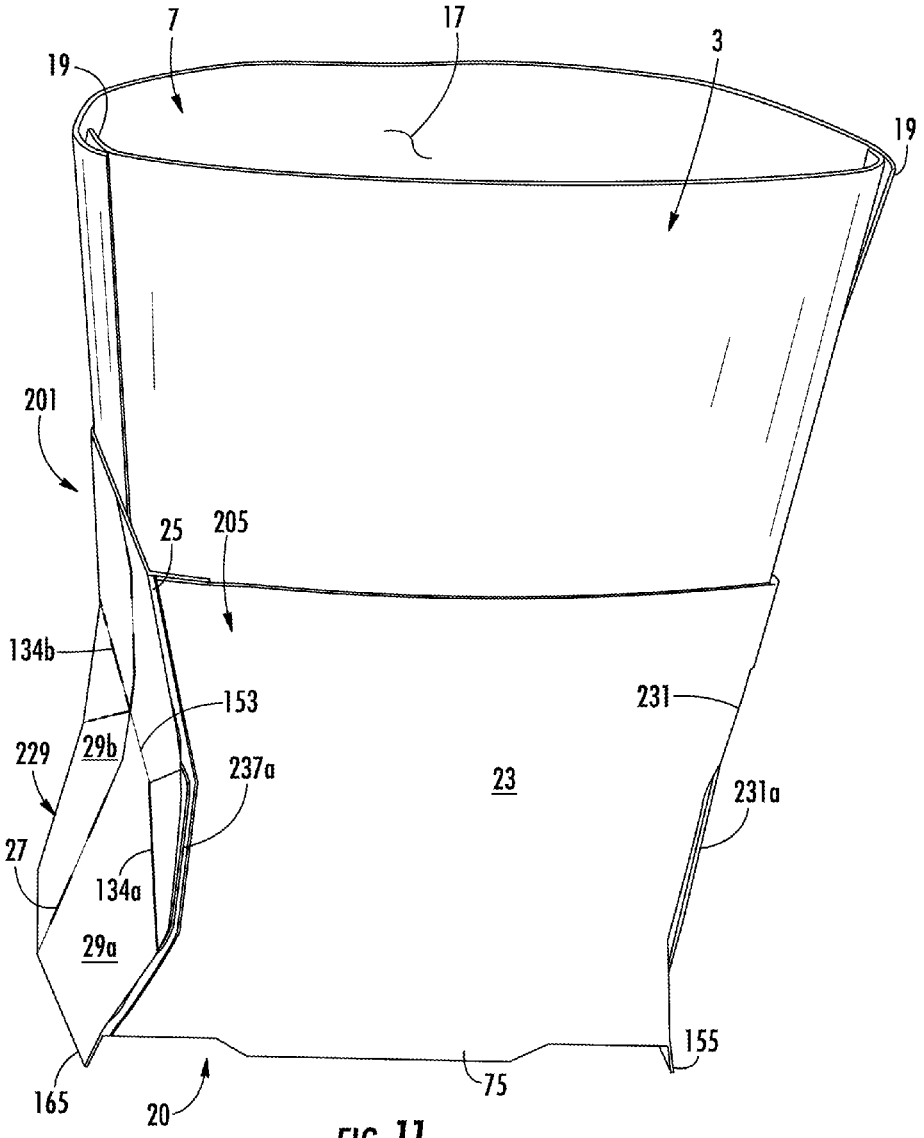
FIGS. 11 and 12 are perspective views of the package formed from the carton blank of FIG. 10 and bag of FIG. 2 according to the third exemplary embodiment of the disclosure.
Figure 12:
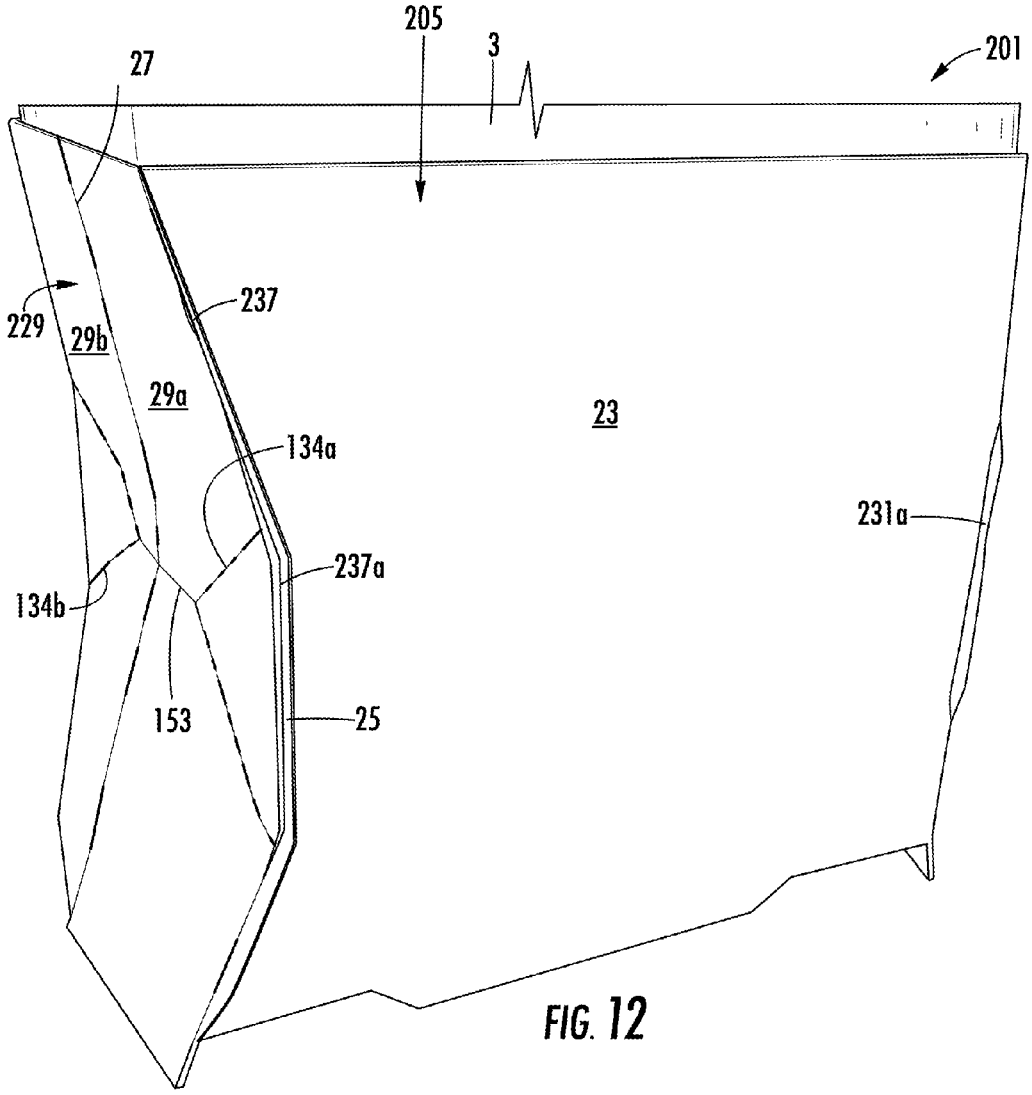

FIG. 10 is a plan view of a blank 210 for forming a construct 205 (FIGS. 11 and 12) of a third embodiment of the disclosure. The third embodiment is generally similar to the previous embodiments, except for variations noted and variations that will be apparent to one of ordinary skill in the art. Accordingly, similar or identical features of the embodiments have been given like or similar reference numbers. As shown in FIG. 10, the fold lines 231, 233, 235, 237 have respective cut portions 231*a*, 233*a*, 235*a*, 237*a* that generally extend in the lateral direction L1 of the blank 210 between the respective oblique portions 231*b*, 231*c* ; 233*b*, 233*c* ; 235*b*, 235*c* ; 237*b*, 237*c*. The blank 210 and/or the carton 205 could have other features or the features shown could be otherwise shaped and/or arranged without departing from the disclosure.

Any of the features of the various embodiments of the disclosure can be combined with, replaced by, or otherwise configured with other features of other embodiments of the disclosure without departing from the scope of this disclosure.

Generally, as described herein, liners or bags can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A reinforced package, comprising:

a carton comprising a plurality of panels that extends at least partially around an interior of the carton, the plurality of panels comprising a front panel, a first side panel foldably connected to the front panel along a first fold line, a back panel foldably connected to at least the first side panel along a second fold line, and a second side panel foldably connected to at least one of the front panel and the back panel; and a bag at least partially attached to the carton, the bag having an at least partially open end, an at least partially closed end, and an interior space for holding a product;

wherein the carton is positionable in a non-erect position wherein the interior space of the bag is at least partially collapsed and in an erect position wherein the interior space of the bag is increased, and the carton is configured to support the bag in the erect position;

wherein the first side panel and the second side panel comprise retention features for at least partially retaining the carton in the erect position, and the retention features comprise at least a V-shaped fold line extending from the first fold line and extending in the first side panel.

2. The reinforced package of claim 1, wherein the V-shaped fold line comprises a vertex that is spaced apart from the first fold line.

3. The reinforced package of claim 2, wherein the retention features further comprise a longitudinal fold line extending from the vertex of the V-shaped fold line and extending in the first side panel.

4. The reinforced package of claim 1, wherein the V-shaped fold line comprises a first end and a second end, each engaging the first fold line.

5. The reinforced package of claim 4, wherein the first fold line comprises an arcuate portion, a first oblique portion extending from the arcuate portion, and a second oblique portion extending from the arcuate portion.

6. The reinforced package of claim 5, wherein the arcuate portion is an arcuate cut.

7. The reinforced package of claim 4, wherein the first fold line comprises a first oblique portion and a second oblique portion, the first end of the V-shaped fold line engages the first oblique portion of the first fold line, and the second end of the V-shaped fold line engages the second oblique portion of the first fold line.

8. The reinforced package of claim 7, wherein:

the V-shaped fold line is a first V-shaped fold line, and the second fold line comprises a third oblique portion and a fourth oblique portion; and the retention features further comprise a second V-shaped fold line extending in the first side panel and having a third end that engages the third oblique portion of the second fold line and a fourth end that engages the fourth oblique portion of the second fold line.

9. The reinforced package of claim 7, wherein the retention features further comprise a longitudinal fold line extending from the V-shaped fold line and extending in the first side panel.

10. The reinforced package of claim 9, wherein the first side panel comprises a first panel portion foldably connected to a second panel portion along a lateral fold line, and the longitudinal fold line extends from the V-shaped fold line to at least the lateral fold line.

11. The reinforced package of claim 9, wherein a portion of the first side panel extends generally upwardly and outwardly from the longitudinal fold line and the V-shaped fold line and another portion of the first side panel extend generally downwardly and outwardly from the longitudinal fold line and the V-shaped fold line when the carton is in the erect position.

12. The reinforced package of claim 1, wherein the V-shaped fold line is a first V-shaped fold line, and the retention features further comprise a second V-shaped fold line extending from the second fold line and extending in the first side panel.

13. The reinforced package of claim 12, wherein a longitudinal fold line extends in at least the first side panel from the first V-shaped fold line to the second V-shaped fold line.

14. The reinforced package of claim 13, wherein the first V-shaped fold line comprises a first vertex and the second V-shaped fold line comprises a second vertex, and the longitudinal fold line extends from each of the first vertex and the second vertex.

15. The reinforced package of claim 13, wherein the first side panel comprises a first panel portion foldably connected to a second panel portion along a lateral fold line, and the longitudinal fold line intersects the lateral fold line.

16. The reinforced package of claim 12, wherein the first V-shaped fold line comprises a first end and a second end, each engaging the first fold line, and the second V-shaped fold line comprises a third end and a fourth end, each engaging the second fold line.

17. The reinforced package of claim 16, wherein the first fold line comprises a first oblique portion and a second oblique portion, the second fold line comprises a third oblique portion and a fourth oblique portion, the first end of the first V-shaped fold line engages the first oblique portion of the first fold line, the second end of the first V-shaped fold line engages the second oblique portion of the first fold line, the third end of the second V-shaped fold line engages the third oblique portion of the second fold line, and the fourth end of the second V-shaped fold line engages the fourth oblique portion of the second fold line.

18. The reinforced package of claim 1, wherein the first side panel comprises a first panel portion foldably connected to a second panel portion along a lateral fold line, the V-shaped fold line comprises a first end and a second end, each engaging the first fold line, V-shaped fold line comprises a vertex that is spaced apart from the lateral fold line by a first distance and from the first end by a second distance, and the second distance is greater than the first distance.

19. The reinforced package of claim 1, wherein each of the first fold line and the second fold line comprises an arcuate portion, a first oblique portion extending from the arcuate portion, and a second oblique portion extending from the arcuate portion opposite to the first oblique portion.

20. The reinforced package of claim 1, wherein each of the first fold line and the second fold line comprises a lateral portion, a first oblique portion extending from the lateral portion, and a second oblique portion extending from the lateral portion opposite to the first oblique portion.

21. The reinforced package of claim 1, wherein the carton further comprises a bottom end flap foldably connected to at least one of the front panel and the back panel, a bottom fold line extends at least partially across the bottom end flap, and the bottom end flap is at least partially folded along the bottom fold line when the carton is in the non-erect position.

22. The reinforced package of claim 21, wherein the bottom end flap is a first bottom end flap, and the carton further comprises a second bottom end flap foldably connected to at least one of the front panel and the back panel, and the first bottom end flap and the second bottom end flap are at least partially overlapped with respect to one another to at least partially form a bottom of the carton.

23. In combination, a carton blank and a bag for forming a reinforced package for holding a product:

the carton blank being for forming a carton, the carton blank comprising a plurality of panels comprising a front panel, a first side panel foldably connected to the front panel along a first fold line, a back panel foldably connected to at least the first side panel along a second fold line, and a second side panel foldably connected to at least one of the front panel and the back panel; and the bag having an at least partially open end, an at least partially closed end, and an interior space for holding a product, the bag being at least partially attached to the carton blank;

wherein the reinforced package formed from the carton blank and the bag is positionable in a non-erect position wherein the interior space of the bag is at least partially collapsed and in an erect position wherein the interior space of the bag is increased;

wherein the first side panel and the second side panel comprise retention features for at least partially retaining the carton formed from the carton blank in the erect position, and the retention features comprise at least a V-shaped fold line extending from the first fold line and extending in the first side panel.

24. The combination of claim 23, wherein the V-shaped fold line comprises a vertex that is spaced apart from the first fold line.

25. The combination of claim 24, wherein the retention features further comprise a longitudinal fold line extending from the vertex of the V-shaped fold line and extending in the first side panel.

26. The combination of claim 23, wherein the V-shaped fold line comprises a first end and a second end, each engaging the first fold line.

27. The combination of claim 26, wherein the first fold line comprises an arcuate portion, a first oblique portion extending from the arcuate portion, and a second oblique portion extending from the arcuate portion.

28. The combination of claim 27, wherein the arcuate portion is an arcuate cut.

29. The combination of claim 26, wherein the first fold line comprises a first oblique portion and a second oblique portion, the first end of the V-shaped fold line engages the first oblique portion of the first fold line, and the second end of the V-shaped fold line engages the second oblique portion of the first fold line.

30. The combination of claim 29, wherein:

the V-shaped fold line is a first V-shaped fold line, and the second fold line comprises a third oblique portion and a fourth oblique portion; and the retention features further comprise a second V-shaped fold line extending in the first side panel and having a third end that engages the third oblique portion of the second fold line and a fourth end that engages the fourth oblique portion of the second fold line.

31. The combination of claim 29, wherein the retention features further comprise a longitudinal fold line extending from the V-shaped fold line and extending in the first side panel.

32. The combination of claim 31, wherein the first side panel comprises a first panel portion foldably connected to a second panel portion along a lateral fold line, and the longitudinal fold line extends from the V-shaped fold line to at least the lateral fold line.

33. The combination of claim 23, wherein the V-shaped fold line is a first V-shaped fold line, and the retention features further comprise a second V-shaped fold line extending from the second fold line and extending in the first side panel.

34. The combination of claim 33, wherein a longitudinal fold line extends in at least the first side panel from the first V-shaped fold line to the second V-shaped fold line.

35. The combination of claim 34, wherein the first V-shaped fold line comprises a first vertex and the second V-shaped fold line comprises a second vertex, and the longitudinal fold line extends from each of the first vertex and the second vertex.

36. The combination of claim 34, wherein the first side panel comprises a first panel portion foldably connected to a second panel portion along a lateral fold line, and the longitudinal fold line intersects the lateral fold line.

37. The combination of claim 33, wherein the first V-shaped fold line comprises a first end and a second end, each engaging the first fold line, and the second V-shaped fold line comprises a third end and a fourth end, each engaging the second fold line.

38. The combination of claim 37, wherein the first fold line comprises a first oblique portion and a second oblique portion, the second fold line comprises a third oblique portion and a fourth oblique portion, the first end of the first V-shaped fold line engages the first oblique portion of the first fold line, the second end of the first V-shaped fold line engages the second oblique portion of the first fold line, the third end of the second V-shaped fold line engages the third oblique portion of the second fold line, and the fourth end of the second V-shaped fold line engages the fourth oblique portion of the second fold line.

39. The combination of claim 23, wherein the first side panel comprises a first panel portion foldably connected to a second panel portion along a lateral fold line, the V-shaped fold line comprises a first end and a second end, each engaging the first fold line, the V-shaped fold line comprises a vertex that is spaced apart from the lateral fold line by a first distance and from the first end by a second distance, and the second distance is greater than the first distance.

40. The combination of claim 23, wherein each of the first fold line and the second fold line comprises an arcuate portion, a first oblique portion extending from the arcuate portion, and a second oblique portion extending from the arcuate portion opposite to the first oblique portion.

41. The combination of claim 23, wherein each of the first fold line and the second fold line comprises a lateral portion, a first oblique portion extending from the lateral portion, and a second oblique portion extending from the lateral portion opposite to the first oblique portion.

42. The combination of claim 23, wherein the carton blank further comprises a bottom end flap foldably connected to at least one of the front panel and the back panel, a bottom fold line extends at least partially across the bottom end flap, and the bottom end flap is for being at least partially folded along the bottom fold line when the carton formed from the carton blank is in the non-erect position.

43. The combination of claim 42, wherein the bottom end flap is a first bottom end flap, the carton blank further comprises a second bottom end flap foldably connected to at least one of the front panel and the back panel, and the first bottom end flap and the second bottom end flap are for being at least partially overlapped with respect to one another to at least partially form a bottom of the carton when the carton is formed from the blank.

44. A method of forming a reinforced package comprising:

obtaining a carton blank at least partially attached to a bag, the carton blank comprising a plurality of panels comprising a front panel, a first side panel foldably connected to the front panel along a first fold line, a back panel foldably connected to at least the first side panel along a second fold line, and a second side panel foldably connected to at least one of the front panel and the back panel, and the bag comprising an at least partially open end, an at least partially closed end, and an interior space for holding a product;

forming an interior of a carton at least partially defined by the plurality of panels by folding the plurality of panels at least partially around the bag;

wherein the carton is positionable in a non-erect position wherein the interior space of the bag is at least partially collapsed and in an erect position wherein the interior space of the bag is increased, and the carton is configured to support the bag in the erect position;

wherein the first side panel and the second side panel comprise retention features for at least partially retaining the carton in the erect position, and the retention features comprise at least a V-shaped fold line extending from the first fold line and extending in the first side panel.

45. The method of claim 44, wherein the V-shaped fold line comprises a vertex that is spaced apart from the first fold line, and the retention features further comprise a longitudinal fold line extending from the vertex of the V-shaped fold line and extending in the first side panel.

46. The method of claim 44, wherein the V-shaped fold line comprises a first end and a second end, each engaging the first fold line, the first fold line comprises a first oblique portion and a second oblique portion, the first end of the V-shaped fold line engages the first oblique portion of the first fold line, and the second end of the V-shaped fold line engages the second oblique portion of the first fold line.

47. The method of claim 44, wherein:

the V-shaped fold line is a first V-shaped fold line, and the retention features further comprise a second V-shaped fold line extending from the second fold line and extending in the first side panel;

the first V-shaped fold line comprises a first vertex and the second V-shaped fold line comprises a second vertex; and a longitudinal fold line extends in at least the first side panel from the first vertex of the first V-shaped fold line to the second vertex of the second V-shaped fold line.

48. The method of claim 47, wherein a portion of the first side panel extends generally upwardly and outwardly from the longitudinal fold line and the V-shaped fold line and another portion of the first side panel extend generally downwardly and outwardly from the longitudinal fold line and the V-shaped fold line when the carton is in the erect position.

49. The method of claim 44, wherein the first side panel comprises a first panel portion foldably connected to a second panel portion along a lateral fold line, the V-shaped fold line comprises a first end and a second end, each engaging the first fold line, the V-shaped fold line comprises a vertex that is spaced apart from the lateral fold line by a first distance and from the first end by a second distance, and the second distance is greater than the first distance.

50. The method of claim 44, wherein each of the first fold line and the second fold line comprises an arcuate portion, a first oblique portion extending from the arcuate portion, and a second oblique portion extending from the arcuate portion opposite to the first oblique portion.

51. The method of claim 44, wherein each of the first fold line and the second fold line comprises a lateral portion, a first oblique portion extending from the lateral portion, and a second oblique portion extending from the lateral portion opposite to the first oblique portion.

52. The method of claim 44, wherein:

the carton blank further comprises a first bottom end flap foldably connected to at least one of the front panel and the back panel and a second bottom end flap foldably connected to at least one of the front panel and the back panel;

the forming the carton further comprises at least partially forming a bottom of the carton by at least partially overlapping the first bottom end flap and the second bottom end flap; and a bottom fold line extends at least partially across the first bottom end flap, and the first bottom end flap is at least partially folded along the bottom fold line when the carton is in the non-erect position.

* * * * *